US012178277B2

(12) United States Patent
Levesque et al.

(10) Patent No.: US 12,178,277 B2
(45) Date of Patent: Dec. 31, 2024

(54) VISOR ASSEMBLY WITH UNIQUE PLATE

(71) Applicant: KIMPEX INC., Drummondville (CA)

(72) Inventors: Jean-Simon Levesque, Victoriaville (CA); Frederic Rene-Laforest, Drummondville (CA); Charles Blouin, Saint Germain de Grantham (CA); Stephane Dion, Granby (CA); Philippe Pages, Lévis (CA)

(73) Assignee: KIMPEX INC., Drummondville (CA)

( * ) Notice: Subject to any disclaimer, the term of this patent is extended or adjusted under 35 U.S.C. 154(b) by 36 days.

(21) Appl. No.: 18/109,530

(22) Filed: Feb. 14, 2023

(65) Prior Publication Data

US 2023/0255301 A1 Aug. 17, 2023

Related U.S. Application Data

(60) Provisional application No. 63/268,146, filed on Feb. 17, 2022.

(51) Int. Cl.
*A42B 3/22* (2006.01)

(52) U.S. Cl.
CPC ..... *A42B 3/222* (2013.01); *A42B 3/226* (2013.01)

(58) Field of Classification Search
CPC ..... A42B 3/221; Y10S 2/909; A61F 9/025; Y10T 24/45471
See application file for complete search history.

(56) References Cited

U.S. PATENT DOCUMENTS

| | | | | |
|---|---|---|---|---|
| 4,748,696 | A * | 6/1988 | Fohl | A42B 3/223 2/10 |
| 4,907,300 | A * | 3/1990 | Dampney | A42B 3/228 2/424 |
| 5,005,221 | A * | 4/1991 | Chen | A42B 3/222 2/424 |
| 5,062,162 | A | 11/1991 | Kamata | |
| 5,177,816 | A * | 1/1993 | Schmidt | A42B 3/221 2/909 |
| 6,047,409 | A * | 4/2000 | Simpson | A42B 3/223 2/424 |
| 6,161,225 | A * | 12/2000 | Arai | A42B 3/226 2/424 |
| 6,301,721 | B1 * | 10/2001 | Arai | A42B 3/222 2/424 |
| 6,795,978 | B2 | 9/2004 | Fournier et al. | |
| 10,413,010 | B2 | 9/2019 | Dutour et al. | |
| 10,568,380 | B2 | 2/2020 | Salvetti et al. | |
| 10,869,521 | B2 | 12/2020 | Kim et al. | |
| 10,973,274 | B2 | 4/2021 | Levesque et al. | |
| 2002/0189005 | A1 * | 12/2002 | Taniuchi | A42B 3/223 2/424 |

(Continued)

*Primary Examiner* — Jillian K Pierorazio
(74) *Attorney, Agent, or Firm* — Crowell & Moring LLP

(57) ABSTRACT

A helmet is provided which includes a helmet shell defining a cavity. The helmet shell has left and right helmet mounting sections defined on left and right sides thereof, and the helmet includes a visor mounting system comprising a primary visor connector made of a single piece and adapted for connection with the left and right helmet mounting sections. The helmet further has a primary visor removably and pivotally connected to the primary visor connector and adapted to pivot about a primary pivot axis.

20 Claims, 25 Drawing Sheets

(56) References Cited

U.S. PATENT DOCUMENTS

2004/0049830 A1* 3/2004 Gafforio ..... A42B 3/222 2/171
2004/0143888 A1* 7/2004 Bataille ..... A42B 3/228 2/410
2005/0273912 A1* 12/2005 Gafforio ..... A42B 3/226 2/424
2006/0064799 A1* 3/2006 Dion ..... A42B 3/326 2/424
2007/0074335 A1* 4/2007 Gafforio ..... A42B 3/223 2/410
2007/0124851 A1* 6/2007 Pyo ..... A42B 3/222 2/424
2009/0070908 A1* 3/2009 Gafforio ..... A42B 3/226 2/15
2009/0288242 A1* 11/2009 Kato ..... A42B 3/223 24/604
2010/0005558 A1* 1/2010 Lee ..... A42B 3/223 2/15
2010/0132085 A1* 6/2010 Beaudet ..... A42B 3/221 2/6.5
2011/0094019 A1* 4/2011 Isobe ..... A42B 3/222 2/424
2012/0284906 A1* 11/2012 Kuo ..... A42B 3/223 2/424
2013/0025015 A1* 1/2013 Isobe ..... A42B 3/222 2/10
2013/0031699 A1* 2/2013 Gafforio ..... A42B 3/226 2/411
2013/0129449 A1* 5/2013 Ishikawa ..... F16B 5/10 411/509
2013/0191976 A1* 8/2013 Pizzi ..... A42B 3/223 2/424
2014/0352020 A1* 12/2014 Isobe ..... A42B 3/223 2/9
2015/0113713 A1* 4/2015 Arai ..... A42B 3/226 2/424
2018/0027916 A1* 2/2018 Smallwood ..... A42B 3/222
2018/0103710 A1* 4/2018 Kim, II ..... A42B 3/326
2018/0168269 A1* 6/2018 Di Troia ..... A42B 3/224
2019/0357624 A1* 11/2019 Rietzler ..... A42B 3/185
2020/0037692 A1* 2/2020 Levesque ..... A42B 3/227
2020/0229529 A1* 7/2020 Hunt ..... A42B 3/223
2020/0253316 A1* 8/2020 Isobe ..... A42B 3/226
2021/0321711 A1* 10/2021 Fiorino ..... A42B 3/222
2022/0248796 A1* 8/2022 Rietdyk ..... A42B 3/228

* cited by examiner

VISOR ASSEMBLY WITH UNIQUE PLATE

CROSS-REFERENCE TO RELATED APPLICATIONS

This application claims the benefit of U.S. Provisional Application No. 63/268,146, filed Feb. 17, 2022, entitled "VISOR ASSEMBLY WITH UNIQUE PLATE", the entirety of which is hereby incorporated by reference.

TECHNICAL FIELD

The technical field generally relates to helmets, and more particularly to helmets provided with a visor mounting system adapted for connection of one or two visors to the helmet and using a unique mounting plate design.

BACKGROUND

Helmets used for outdoor activities typically include a shell that defines a cavity for housing a wearer's head, and a front opening to allow the wearer to see. For helmets used for winter activities, such as snowmobiling, the front opening can be covered by goggles, or by a visor that is pivotally mounted to the helmet shell, to protect the eyes of the wearer when riding. The systems used to pivotally connect the visor to the helmet shell typically include components installed on the left and right sides of the helmet shell. The left and right components are typically mirror versions of themselves to enable a symmetry between the left and right mounting systems, and symmetry of the helmet shell itself.

The mounting systems generally have multiple parts connected to one another and/or to the helmet shell, and which are operable to enable unhindered rotation of the visor, and selective disconnection of the visor. Some helmets can include multiple visors, which can require multiple mounting systems and additional parts.

There is therefore a need for a helmet, or helmet assembly, adapted to facilitate connection and disconnection of one or more visors, and overcome at least some of the drawbacks of what is known in the field.

SUMMARY

According to an aspect of the present disclosure, there is provided a helmet. The helmet includes a helmet shell defining a cavity and comprising left and right helmet mounting sections defined on left and right sides thereof. The helmet also includes a visor mounting system comprising a pair of mounting bases having a unitary body connectable to the mounting sections, the unitary body having an inner surface and an outer surface. The helmet further includes a visor having visor mounting sections removably and pivotally connected to one of the inner surface and the outer surface of the unitary bodies, where the unitary bodies are made of a single one-piece unit and are interchangeable to enable connection with either one of the left and right helmet mounting sections.

According to a possible embodiment, the unitary body is removably connected to the mounting sections of the helmet shell.

According to a possible embodiment, the unitary body is molded or 3D-printed to form the one-piece unit.

According to a possible embodiment, the helmet further includes a secondary visor having secondary mounting sections removably and pivotally connected to the other one of the inner surface and the outer surface of the unitary bodies, between the helmet shell and the mounting bases, and wherein the mounting bases are positioned between the visor and the secondary visor.

According to a possible embodiment, each mounting base comprises a first pivot on the outer surface defining a first pivot axis about which the visor is adapted to rotate, and further comprises a second pivot on the inner surface defining a second pivot axis about which the secondary visor is adapted to rotate.

According to a possible embodiment, the first pivot axis and the second pivot axis are spaced from each other along a length of the mounting base.

According to a possible embodiment, the first pivot axis and the second pivot axis are parallel.

According to a possible embodiment, the first pivot comprises an outer circular flange extending from the outer surface of the unitary body, and wherein the visor mounting sections each comprise an inner circular flange complementarily shaped relative to the outer circular flange to engage therewith.

According to a possible embodiment, the unitary body comprises a radial aperture defined therethrough, and wherein the visor comprises a protrusion extending inwardly proximate one of the visor mounting sections, the protrusion being adapted to engage and travel along the radial aperture to guide a rotational movement of the visor between an open position and a closed position.

According to a possible embodiment, the visor comprises a single protrusion configured to engage the radial aperture of the unitary body of one of the mounting bases.

According to a possible embodiment, the radial aperture is generally concentric relative to the first pivot.

According to a possible embodiment, the radial aperture comprises opposite ends respectively defining rotational stops adapted to prevent further movement of the protrusion.

According to a possible embodiment, each rotational stop comprises a recessed portion for receiving the protrusion therein.

According to a possible embodiment, the unitary body comprises a biasing element extending along at least a portion of the radial aperture, the biasing element being adapted to generate a biasing force on the protrusion within the radial aperture.

According to a possible embodiment, the biasing element comprises a resilient runner extending along a length of the radial aperture.

According to a possible embodiment, the resilient runner is configured to bias the protrusion within the recessed portions.

According to a possible embodiment, the biasing force is directed toward a front section of the unitary body.

According to a possible embodiment, the helmet further includes an anchoring system configured to selectively retain the visor mounting sections connected to the unitary body.

According to a possible embodiment, the anchoring system comprises a visor anchor defined on the visor mounting sections, and a visor anchor retaining profile defined on the unitary body, the visor anchor being adapted to slidably engage the visor anchor retaining profile.

According to a possible embodiment, the visor anchor comprises radial projections extending from the inner circular flange adapted to slidably engage the visor anchor retaining profile and at least partially prevent disengagement of the visor mounting sections from the unitary body.

According to a possible embodiment, the visor anchor retaining profile comprises one or more anchor channels, and wherein the radial projections are adapted to slidably engage the anchor channels during rotational movement of the visor.

According to a possible embodiment, the one or more anchor channels comprise two anchor channels extending opposite one another about the first pivot, and the radial projections comprise two radial projections configured to slidably engage respective anchor channels.

According to a possible embodiment, the anchor channels are generally concentric relative to the first pivot.

According to a possible embodiment, each anchor channel is defined by an overhang extending from and above the outer surface of the unitary body, and wherein the visor anchors are adapted to slidably engage the anchor channel beneath the overhang.

According to a possible embodiment, the anchor channels are concentrically positioned between the radial aperture and the first pivot.

According to a possible embodiment, the second pivot comprises an inner protrusion extending from the inner surface of the unitary body, and wherein the secondary visor mounting sections have an opening shaped and adapted to receive the inner protrusions therein.

According to a possible embodiment, the inner protrusion is cylindrical and comprises a longitudinal axis, and wherein the longitudinal axis corresponds to the second pivot axis.

According to a possible embodiment, the helmet further includes a secondary visor actuator pivotally connected to the inner protrusion of one of the unitary bodies, and wherein the secondary visor mounting sections include an actuated mounting section removably secured to the secondary visor actuator and a support mounting section pivotally connected to the inner protrusion of the other one of the unitary bodies, the secondary visor actuator being selectively pivotable to open and close the secondary visor.

According to a possible embodiment, the actuated mounting section and the support mounting section are asymmetric on either side of the secondary visor.

According to a possible embodiment, the secondary visor actuator comprises an actuator tab pivotally connected to the inner protrusion, the actuator tab comprising a slot configured to receive the actuated mounting section therein.

According to a possible embodiment, the secondary visor actuator and the actuated mounting section are adapted to be selectively interlocked with one another.

According to a possible embodiment, the actuator tab comprises a guiding rail positioned within the slot adapted to engage the opening of the actuated mounting section.

According to a possible embodiment, the guiding rail comprises an elongated segment and a stud, and wherein the opening of the actuated mounting section is adapted to slide along the elongated segment and clip onto the stud for connecting the secondary visor to the actuator tab.

According to a possible embodiment, the guiding rail and the opening of the actuated mounting section are complementarily shaped relative to one another.

According to a possible embodiment, each unitary body comprises a second radial aperture defined therethrough, and wherein the secondary visor actuator comprises a handle extending from the actuator tab through the second radial aperture, wherein the handle is adapted to travel along the second radial aperture to pivot the actuator tab.

According to a possible embodiment, the second radial aperture is generally concentric relative to the second pivot.

According to a possible embodiment, the second radial aperture comprises opposite ends respectively defining radial stops adapted to prevent further movement of the handle along the second radial aperture.

According to a possible embodiment, each radial stop comprises a radial recess for receiving the handle therein.

According to a possible embodiment, the unitary body comprises an actuator biasing element extending along at least a portion of the second radial aperture, the second biasing element being adapted to generate a second biasing force on the handle within the second radial aperture.

According to a possible embodiment, the second biasing force is directed toward the radial recesses of the second radial recess.

According to a possible embodiment, the radial recesses extend radially outwardly and away from the second pivot.

According to a possible embodiment, each the recessed portions extend radially inwardly and toward the first pivot.

According to a possible embodiment, the radial aperture is defined proximate the front section of the unitary body.

According to a possible embodiment, the second radial aperture (160) is defined proximate the rear section of the unitary body.

According to a possible embodiment, each unitary body is adapted to be connected to respective helmet mounting sections for connection therewith via a snap-fit connection.

According to a possible embodiment, the left and right helmet mounting sections are asymmetric to enable the connection of identical mounting bases in respective orientations.

According to a possible embodiment, one of the helmet mounting sections comprises an arcuate guiding section adapted to receive a portion of the handle therein and allow the handle to move therealong when operating the secondary visor actuator.

According to a possible embodiment, the actuator tab is positioned within the cavity of the helmet shell, and wherein the handle extends through a shell opening defined through at least one helmet mounting section and through the second radial aperture.

According to a possible embodiment, the visor mounting sections of the visor are asymmetric to enable connection to the pair of mounting bases positioned in respective orientations.

According to another aspect, a mounting base is provided for a visor mounting system of a helmet having helmet mounting sections provided on either side of a helmet shell, the mounting base having a unitary body comprising an inner surface adapted to face the helmet shell, an outer surface opposite the inner surface, and a front section and a rear section provided opposite one another along a longitudinal axis of the unitary body. The unitary body being connectable to a first one of the helmet mounting sections in a first configuration, and being further removably connectable to a second one of the helmet mounting sections in a second configuration, where the second configuration corresponds to a rotation of the unitary body about the longitudinal axis.

According to another aspect, a helmet is provided having a helmet shell defining a cavity, the helmet shell comprising left and right helmet mounting sections defined on left and right sides thereof. The helmet also includes a visor mounting system comprising a pair of mounting bases having a body connectable to the mounting sections, each body having an inner surface and an outer surface; and a visor having visor mounting sections removably and pivotally connected to the bodies, the visor being adapted to pivot about a first pivot axis. The helmet further includes a secondary visor having secondary visor mounting sections removably and pivotally connected to the bodies, the secondary visor being adapted to pivot about a second pivot axis offset relative to the first pivot axis.

According to another aspect, a helmet is provided having a helmet shell defining a cavity, the helmet shell comprising left and right helmet mounting sections defined on left and right sides thereof; a visor mounting system comprising a pair of mounting bases having a body connectable to the mounting sections, each body having an inner surface and an outer surface; a visor having visor mounting sections removably and pivotally connected to one of the inner surface and the outer surface of the bodies; and a secondary visor having secondary visor mounting sections removably and pivotally connected to the other one of the inner surface and the outer surface of the bodies.

According to a possible embodiment, the bodies are unitary bodies made of a single one-piece unit and are interchangeable to enable connection with either one of the left and right helmet mounting sections.

According to a possible embodiment, one of the visor and the secondary visor is rotatable between an open position and a closed position within the helmet shell.

According to a possible embodiment, one of the visor and the secondary visor is rotatable between an open position and a closed position along an outer surface of the helmet shell.

According to another aspect, a helmet is provided. The helmet includes a helmet shell defining a cavity, the helmet shell comprising left and right helmet mounting sections defined on left and right sides thereof; a visor mounting system comprising a primary visor connector made of a single piece and adapted for connection with the left and right helmet mounting sections; and a primary visor removably and pivotally connected to the primary visor connector and adapted to pivot about a primary pivot axis.

According to a possible embodiment, the visor mounting system further comprises a secondary visor connector made of a singular piece, the secondary visor connector being removably and operatively coupled to the primary visor connector, and wherein the helmet further comprises a secondary visor removably and pivotally connected to the secondary visor connector.

According to a possible embodiment, the primary visor is configured for direct manual operation for enabling rotational movement thereof, and wherein the secondary visor is configured for manual operation via the secondary visor connector for enabling rotational movement thereof.

According to a possible embodiment, the primary visor connector is positioned between a portion of the primary visor and a portion of the secondary visor.

According to a possible embodiment, the secondary visor connector is pivotally coupled to the primary visor connector and configured to pivot about a secondary pivot axis offset relative to the first pivot axis.

According to another aspect, a method of pivotally connecting a visor to a helmet shell provided with a pair of helmet mounting sections is provided. The method includes connecting a visor connector made of a single piece to a first one of the helmet mounting sections; connecting another visor connector made of a single piece to a second one of the helmet mounting sections; and pivotally connecting opposite ends of the visor to respective visor connectors.

According to a possible embodiment, the visor connectors are identical and interchangeable between the helmet mounting sections.

DETAILED DESCRIPTION

Figure 1:
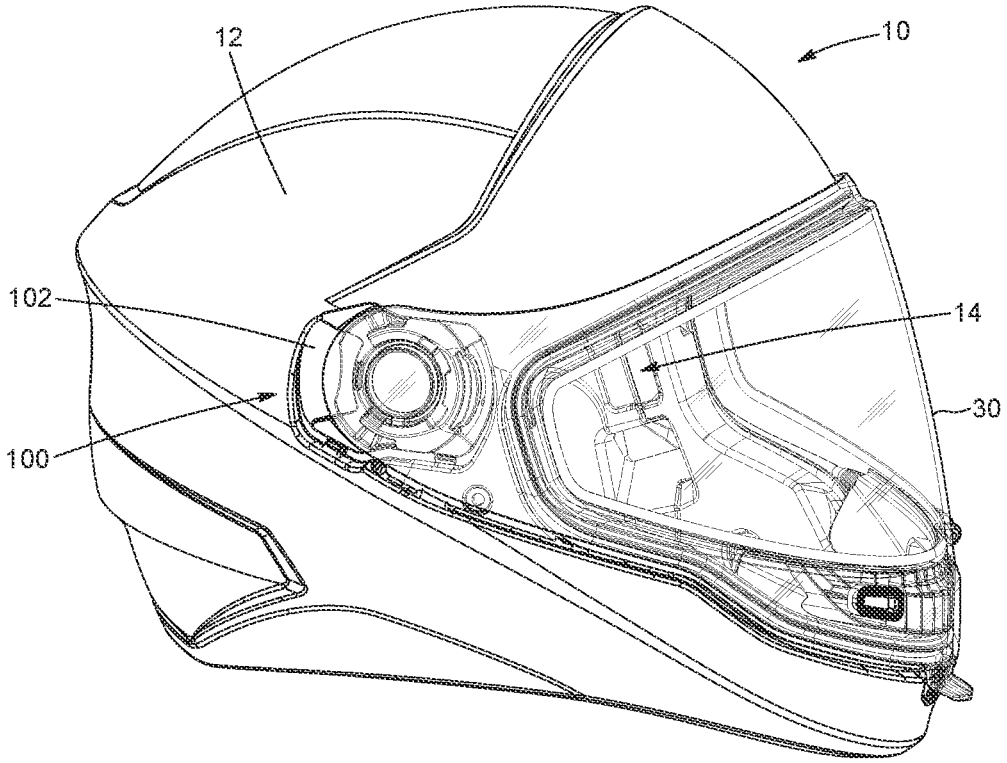
FIG. 1 is a left-side view of a helmet provided with a mounting plate according to a possible embodiment.
Figure 2:
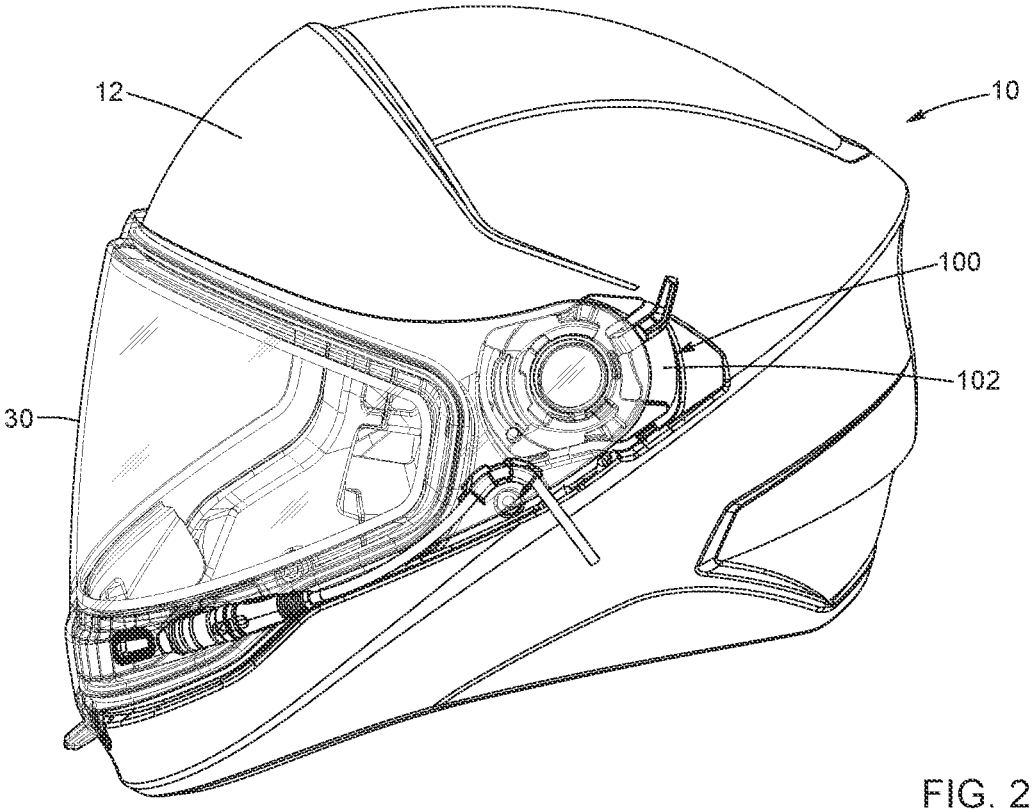
FIG. 2 is a right-side view of the helmet shown in FIG. 1, showing a second mounting plate, according to an embodiment.

As will be explained below in relation to various embodiments, the present disclosure describes a helmet for use in various activities and sports, such as snowmobiling, for example. The helmet includes a visor mounting system (or visor mounting assembly) which includes a pair of mounting bases connectable to left and right sides of the helmet to enable connection of at least one visor to the helmet. The mounting bases include a unitary body (i.e., a body made of a single part/piece) removably connectable to the helmet, with the visor being pivotally connected to the unitary body of the mounting bases for connecting the visor to the helmet. As such, the visor can be selectively operated between a raised/open position and a closed/lowered position. As will be described further below, each unitary body of each mounting base is identical, and thus interchangeable to enable connection to either one of the left and right sides of the helmet.

The mounting base and the helmet shell are configured to cooperate to facilitate connection and disconnection of the mounting bases onto the helmet shell. For example, the mounting bases can be adapted to snap-fit onto the helmet shell. It should thus be noted that a first mounting base can be "snapped" onto the helmet shell, such as on the right side thereof, in a first orientation, and that a second mounting base can be snapped onto the helmet shell, such as on the left side thereof, in a second configuration. In some embodiments, the second configuration can correspond to a rotation of the mounting base, for instance of 180 degrees, about a given axis, such as a longitudinal axis thereof.

In some embodiments, the helmet can include two separate visors, each of which being pivotally connectable to the mounting bases. A first or main visor can be connectable to a first surface of the mounting bases, while a second or secondary (e.g., a sun visor) can be connectable to a second surface of the mounting bases. Moreover, the mounting bases can include first and second pivots such that the first and second visors are adapted to pivot about respective pivoting axes. As will be described, the first and second pivot axes can be offset from one another such that the position and/or the range of motion of one visor differs from the other.

With reference to FIGS. 1 to 4, an embodiment of a helmet 10 is shown. In this embodiment, the helmet 10 includes a protective helmet shell 12 defining a cavity 14 shaped and configured to receive a wearer's head. The helmet shell 12 further has a front opening communicating with the cavity 14 in order to allow the wearer to see. In this embodiment, the helmet 10 has a visor assembly or visor mounting system 100 for pivotally connecting a visor 30 to the helmet shell 12. The visor 30 can be operated (e.g., moved) between a lowered/closed position, where the visor 30 covers and substantially seals the front opening, and a raised/open position. In some embodiments, the visor 30 is adapted to be pivoted upwardly from the closed position to the open position. It is noted that opening the visor positions the visor 30 on an exterior of the helmet 10 (e.g., spaced from an outer surface of the helmet shell 12).

In the illustrated embodiment, the helmet 10 is a full-face type helmet, where the chin guard forms part of the helmet shell 12 (i.e., the chin guard is static). It should be understood that having a static chin guard can reduce the weight of the helmet 10 since the chin guard does not require a pivoting/rotating mechanism, such as a hinge, to pivotally connect the chin guard to the helmet shell 12. By reducing the weight of the helmet 10, the stress applied to the wearer's head and neck can accordingly be reduced, thus increasing overall comfort when wearing the helmet 10. However, it is appreciated that the visor assembly described herein can be used with other types of helmets than full-face type helmets, such as bowl-type helmets, in which the chin guard is a movable chin guard (e.g., the chin guard can be raised along with the visor to reveal/open the front opening) for example.

Figure 3:
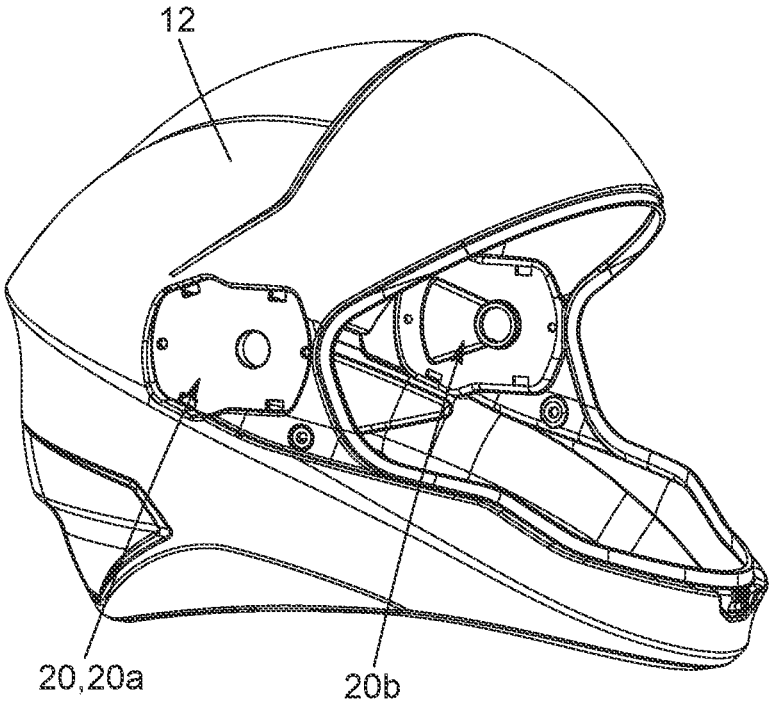
FIGS. 3 and 4 are perspective left-side and right-side views of a helmet shell of the helmet shown in FIG. 1, showing left- and right-side helmet mounting sections, according to an embodiment.
Figure 4:
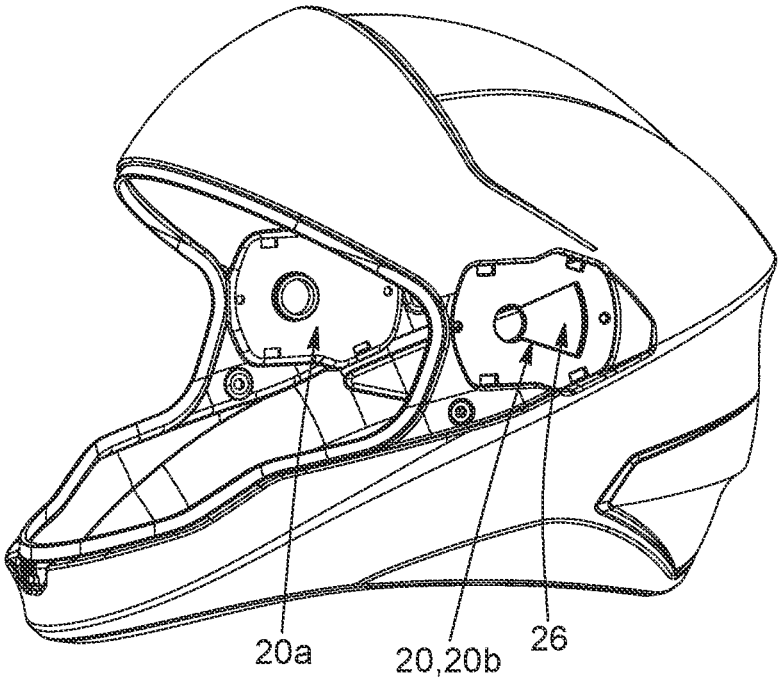
Figure 5:
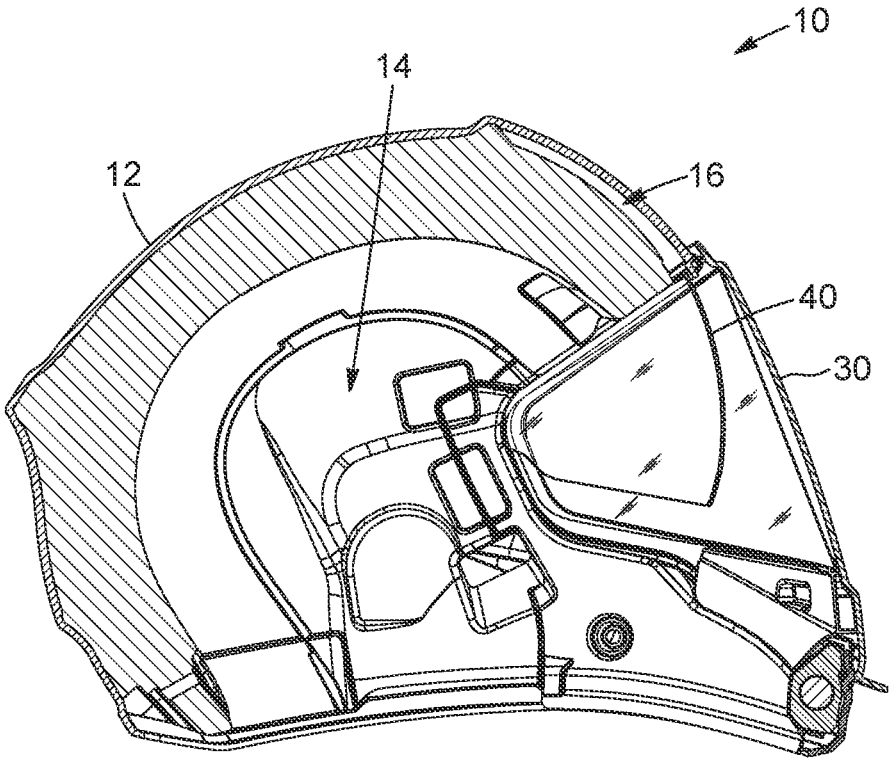
FIGS. 5 and 6 are cross-sectional views of the helmet shown in FIG. 1, showing an outer visor and an inner visor in a lowered position (FIG. 5), and showing the inner visor in the raised position (FIG. 6), according to an embodiment.
Figure 6:
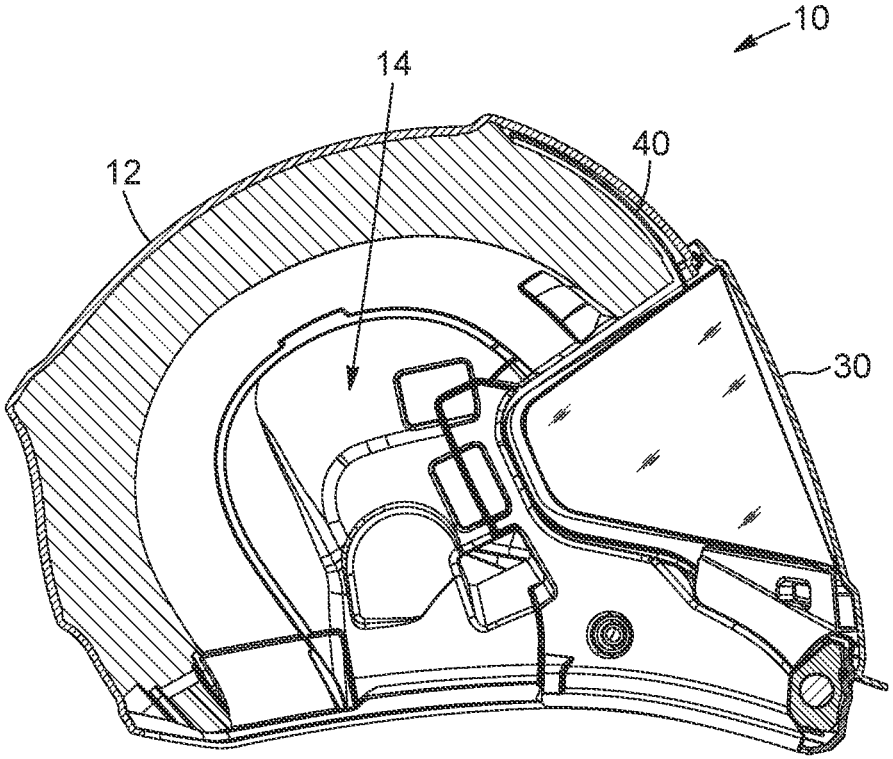

As seen in FIGS. 3 and 4, the helmet shell 12 includes helmet mounting sections 20 defined on left and right sides thereof. In this embodiment, the helmet mounting sections 20 are illustratively recessed on the outer surface of the helmet shell 12 to receive at least a portion of the visor mounting system 100 therein. However, it should be noted that the helmet mounting sections can alternatively have sections protruding from the helmet shell 12 and configured to engage the visor mounting system 100, or a combination of recessed and protruding sections. As will be described further below, the helmet mounting sections 20 can be asymmetric relative to one another, with the left helmet mounting section 20*a* being different than the right helmet mounting section 20*b*. However, as will also be described further below, the left and right helmet mounting sections 20*a*, 20*b* are both configured to cooperate with identical pieces of the visor mounting system 100.

With reference to FIGS. 7, 8, 10, 11, 13 and 14, the visor mounting system 100 can include a pair of mounting bases 102 removably connectable to the helmet shell 12. More specifically, the mounting bases are removably connectable to the helmet mounting sections 20 of the helmet shell 12. In this embodiment, each mounting base 102 includes a unitary body 104 configured to engage a corresponding one of the helmet mounting sections 20. It is appreciated that, as used herein, the expression "unitary body" can refer to a part or piece of the visor mounting system 100 which is made of a single, one-piece unit. The unitary body 104 can thus be molded as the one-piece unit, 3D printed or manufactured/fabricated using any other method, for example. It is noted that the unitary body 104 includes an inner surface 105 (seen in FIGS. 13 and 14) adapted to face the helmet shell 12 when connected to the helmet mounting section 20, and an outer surface 107 (seen in FIGS. 10 and 11) opposite the inner surface 105, adapted to face outwardly. The unitary body 104 can be connected to either one of the left and right helmet mounting sections 20*a*, 20*b*, such that the same piece can be manufactured and/or replicated and installed on the helmet shell 12 (e.g., connected to the helmet mounting sections 20). Errors during assembly and installation of the visor mounting system 100 can thus be prevented since the same piece can be used on both sides of the helmet.

The unitary body 104 can have a length extending along a longitudinal axis between a front section 115 and a rear section 125. In some embodiments, the unitary body 104 of each mounting base 102 is connectable to respective helmet mounting sections 20, and in respective orientations. For example, a first unitary body can be removably connected to a first one of the helmet mounting sections in a first configuration and/or orientation, and a second unitary body can be removably connected to a second one of the helmet mounting sections in a second configuration and/or orientation. The second configuration and/or orientation can correspond to a rotation of the unitary body. For example, the unitary body can be rotated by about 180 degrees about its longitudinal axis between the first and the second configurations. However, it is appreciated that the unitary body can be rotated about other axes and by any other suitable amount (e.g., other than 180 degrees). In some embodiments, the longitudinal axis can correspond to an axis of symmetry of the unitary body, although it is noted that the unitary body can have an absence of any axis of symmetry. It should also be noted that, since the unitary body of each mounting base is the same piece (e.g., they are identical), the first and second unitary bodies can be interchanged between the helmet mounting sections by adjusting their configuration and/or orientation accordingly.

Figure 7:
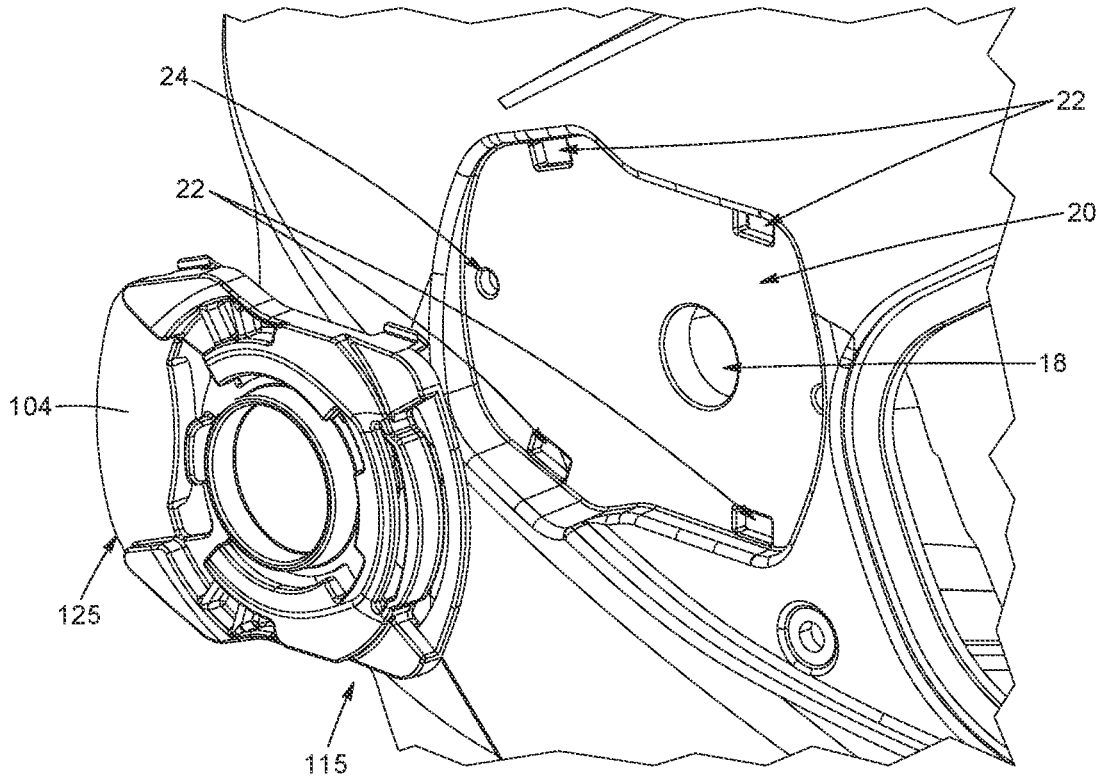
FIG. 7 is a partially exploded side perspective view of the helmet shell shown in FIG. 3, showing a mounting base engageable with the helmet mounting section, according to an embodiment.
Figure 8:
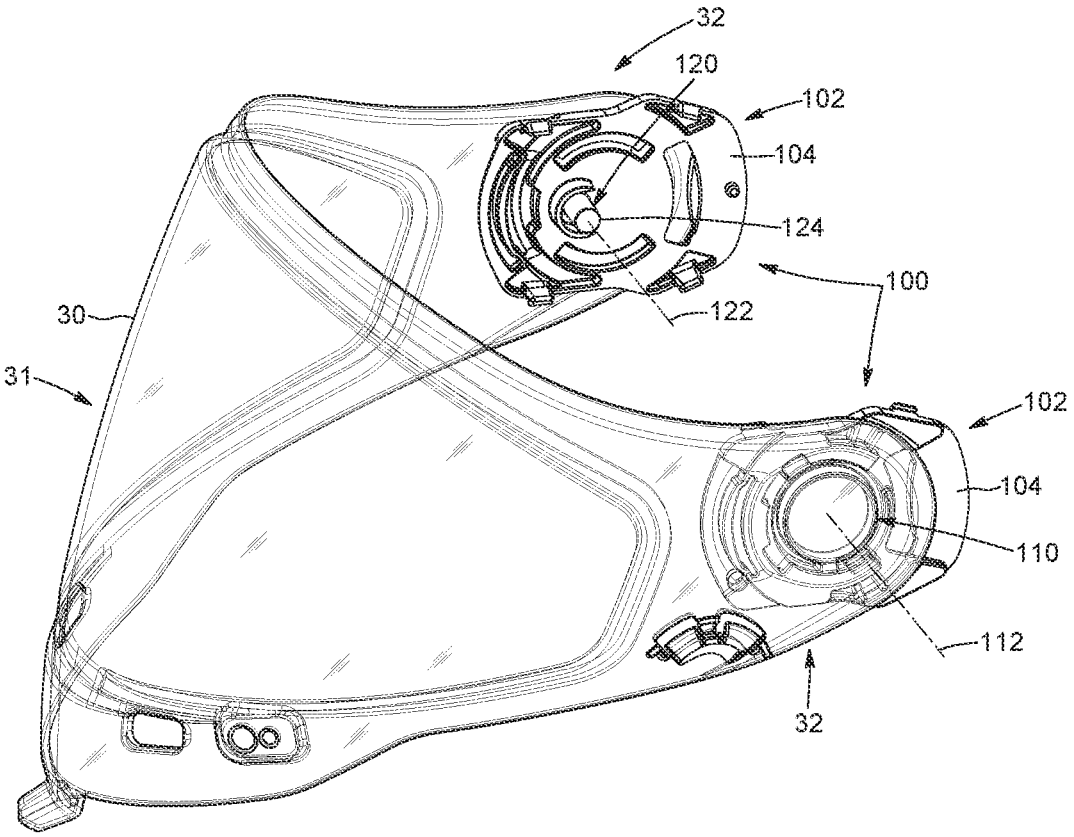
FIG. 8 is a perspective view of the outer visor of the helmet according to an embodiment, showing a pair of mounting bases coupled at opposite ends thereof.
Figure 13:
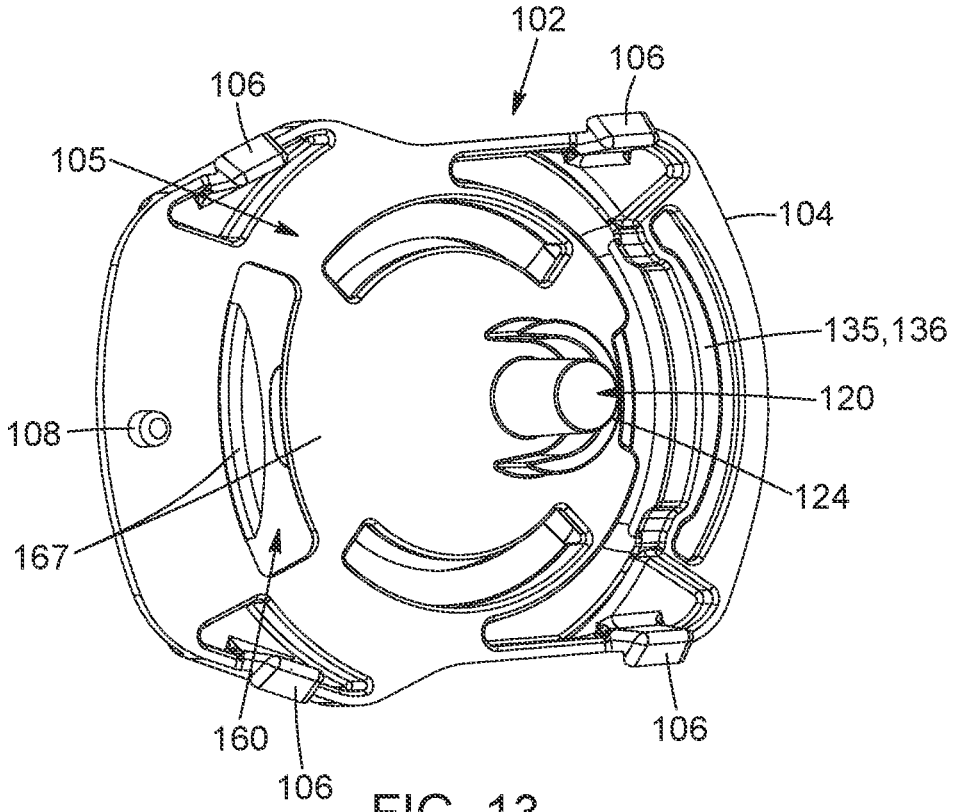
FIG. 13 is a bottom perspective view of the mounting base shown in FIG. 10, showing a second pivot, according to an embodiment.
Figure 14:
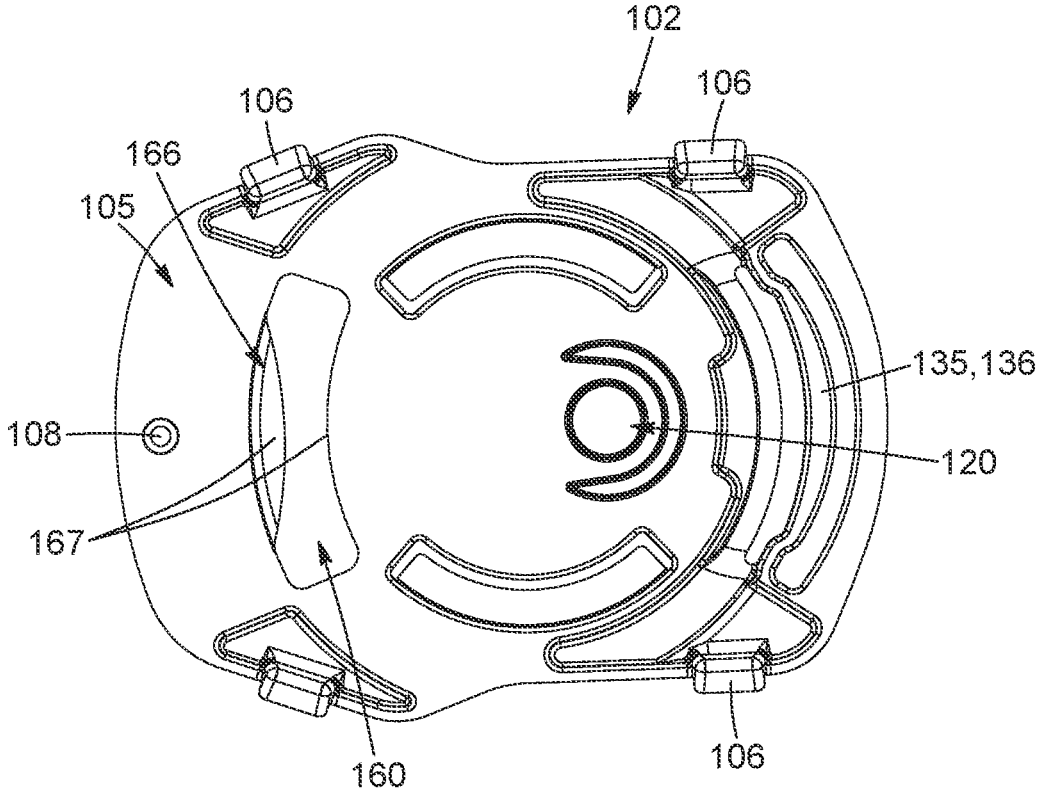
FIG. 14 is a bottom plan view of the mounting base shown in FIG. 13, showing a bottom surface of the mounting base, according to an embodiment.
Figure 15:
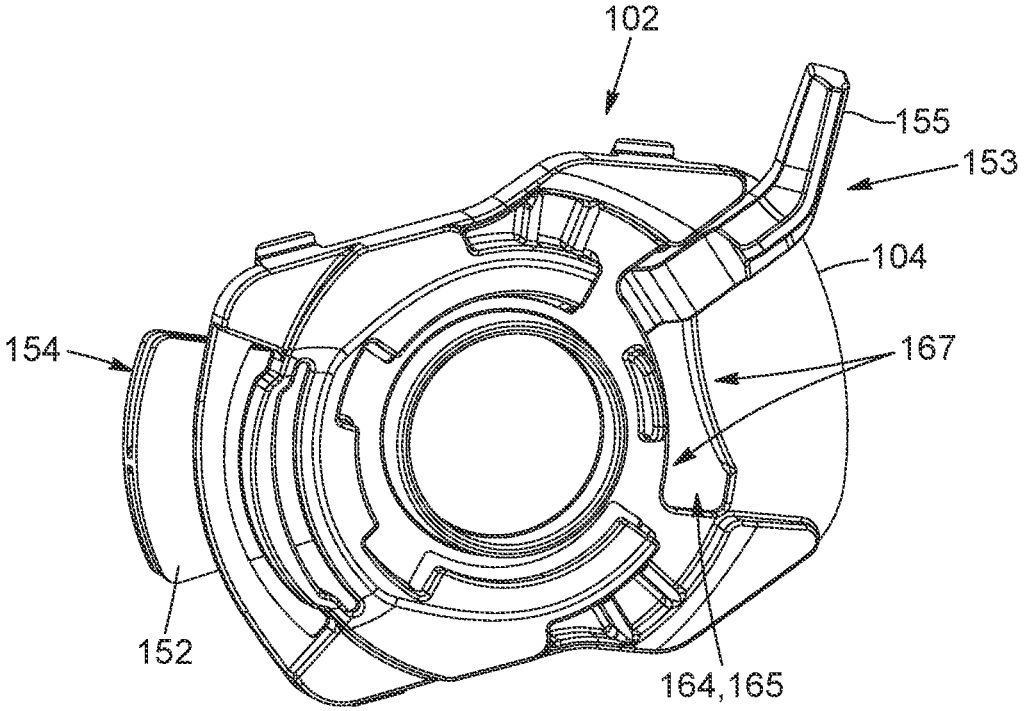
FIGS. 15 and 16 are top and bottom perspective views of the mounting base shown in FIG. 10, showing a handle coupled thereto in a first configuration, according to an embodiment.
Figure 16:
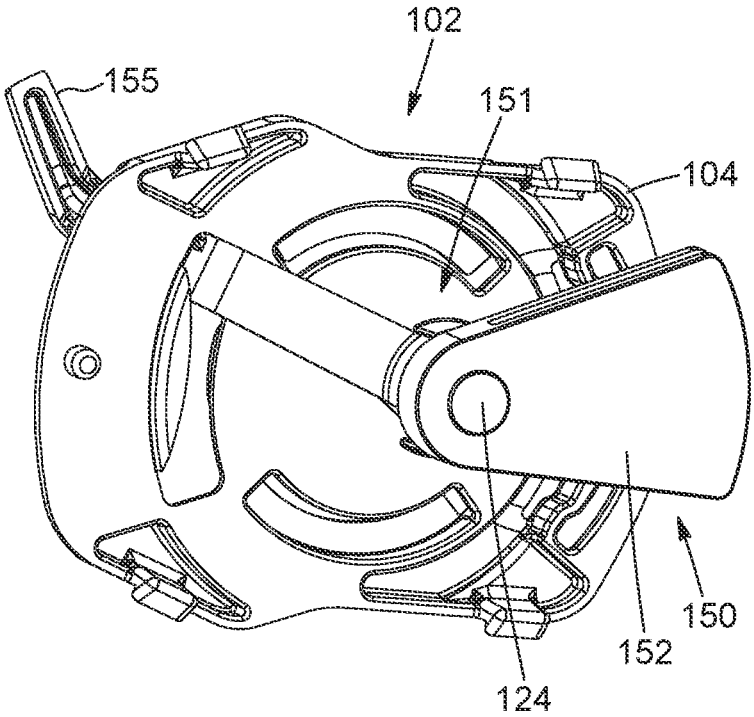
Figure 17:
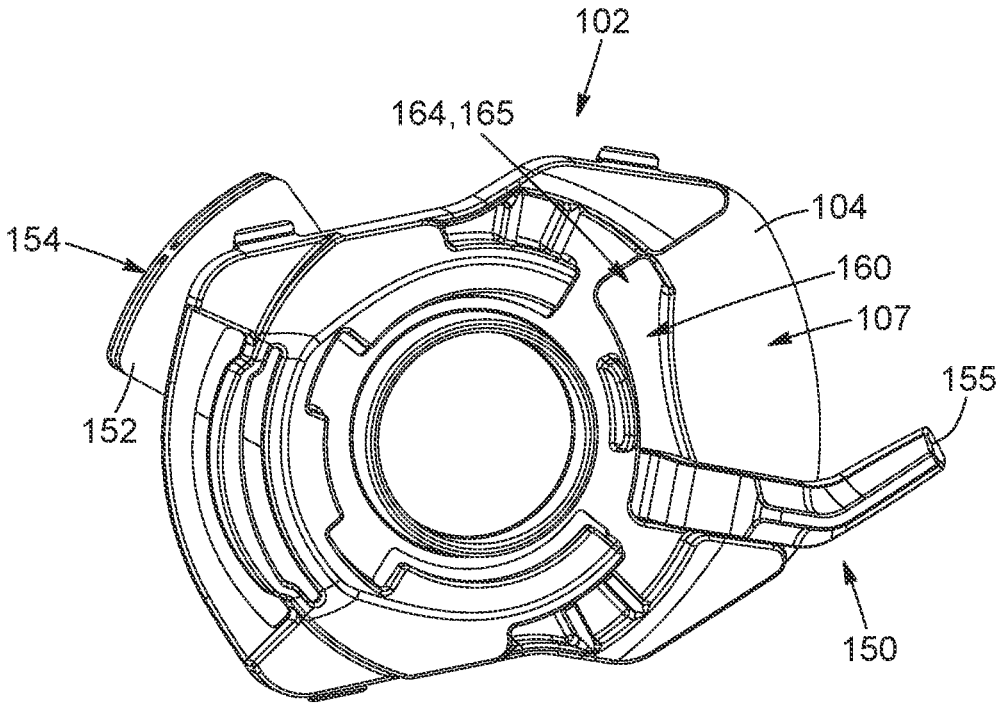
FIGS. 17 and 18 are top and bottom perspective views of the mounting base shown in FIG. 10, showing the handle coupled thereto in a second configuration, according to an embodiment.
Figure 18:
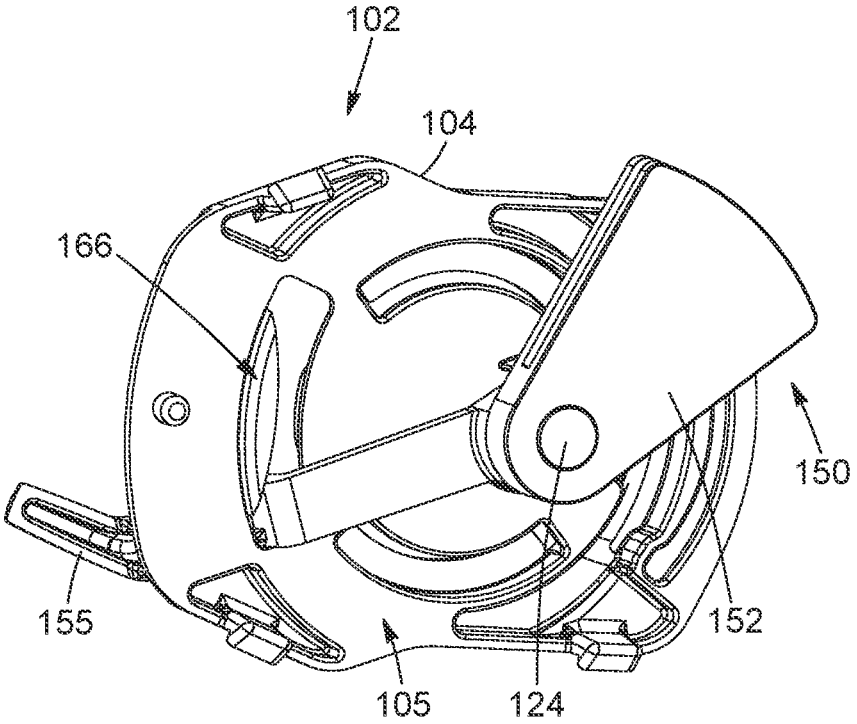

As seen in FIGS. 7, 13 and 14, the unitary body 104 can be connected to the helmet shell 12 (e.g., to the helmet mounting section 20), and more particularly removably connected to the helmet shell, for example, via a snap-fit connection. In some embodiments, the unitary body 104 can include a resilient connection assembly, which can include hook elements 106 configured to engage corresponding hook apertures 22 (seen in FIG. 7) defined in the helmet mounting section 20. The illustrated embodiment includes four resilient hooks 106, and thus four hook apertures 22, although other configurations are possible. In addition, the unitary body 104 can be provided with a positional pin 108 (seen in FIGS. 13 and 14) extending from the inner surface of the unitary body 104 for engaging a positional aperture 24 (seen in FIG. 7) defined on the helmet shell 12, such as within the helmet mounting section 20. The positional pin and aperture are adapted to cooperate to facilitate positioning the mounting base 102 relative to the helmet mounting section 20. In some embodiments, when engaged within the positional aperture, the positional pin can be adapted to absorb forces applied to the mounting base and/or related components, such as an actuating mechanism, which will be described further below. In other words, the positional pin, once inserted within the positional aperture, can act as a shoulder of the mounting base for absorbing forces and retain the unitary body in the desired position, orientation and/or configuration.

With reference to FIGS. 5, 6 and 8 to 14, the visor 30 includes a front portion 31, and is illustratively arcuate between left and right sides thereof, ending in visor mounting sections 32 at opposite ends thereof. The visor mounting sections 32 are configured to be pivotally and removably connected to the unitary bodies 104 to enable opening and closing the visor 30 when wearing the helmet 10. In this embodiment, the visor mounting sections 32 are configured to engage the outer surface 107 of the unitary bodies 102, although other configurations are possible. In some embodiments, the helmet 10 further includes a secondary visor 40, for example a solar shield visor, configured to be pivotally and removably connected to the unitary bodies 104 to enable opening and closing the secondary visor 40. More specifically, the secondary visor 40 is structurally similar to the visor 30 and includes secondary mounting sections 42 pivotally connected to the mounting bases 102. As will be further described below, the secondary mounting sections 42 are adapted to be positioned between the helmet shell 12 and the unitary bodies 104. Thus, it should be noted that the mounting bases 102 are configured to be positioned between the visor 30 and the secondary visor 40 when installed on the helmet 10.

Figure 24:
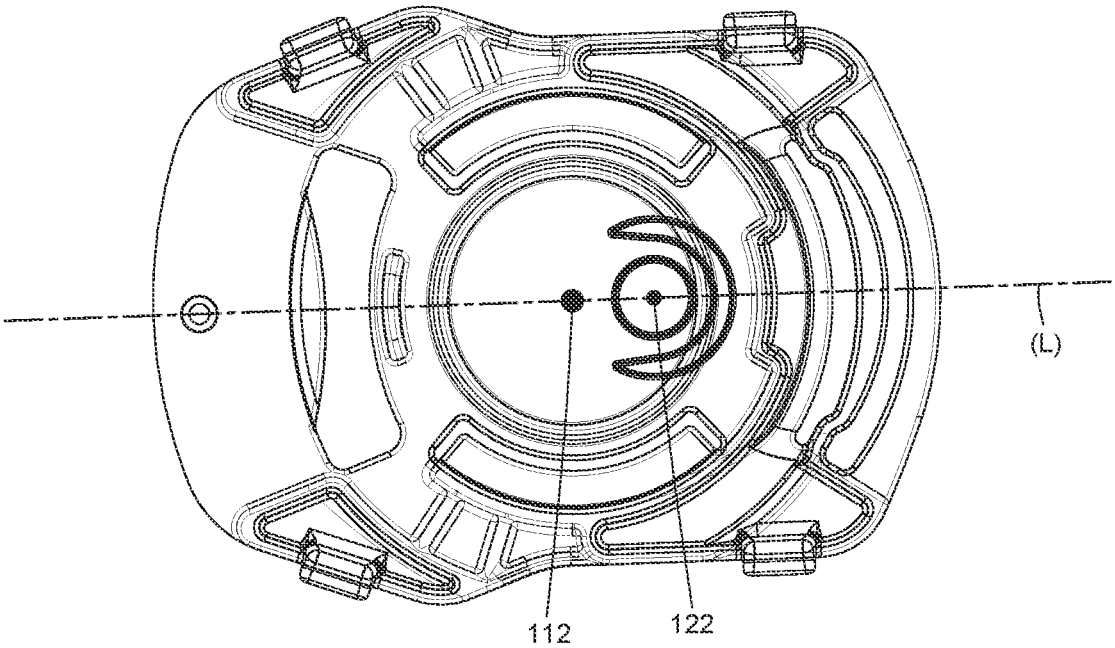
FIG. 24 is a top plan view of the mounting base shown in FIG. 11, showing the first and second pivots offset from one another, according to an embodiment.
Figure 25:
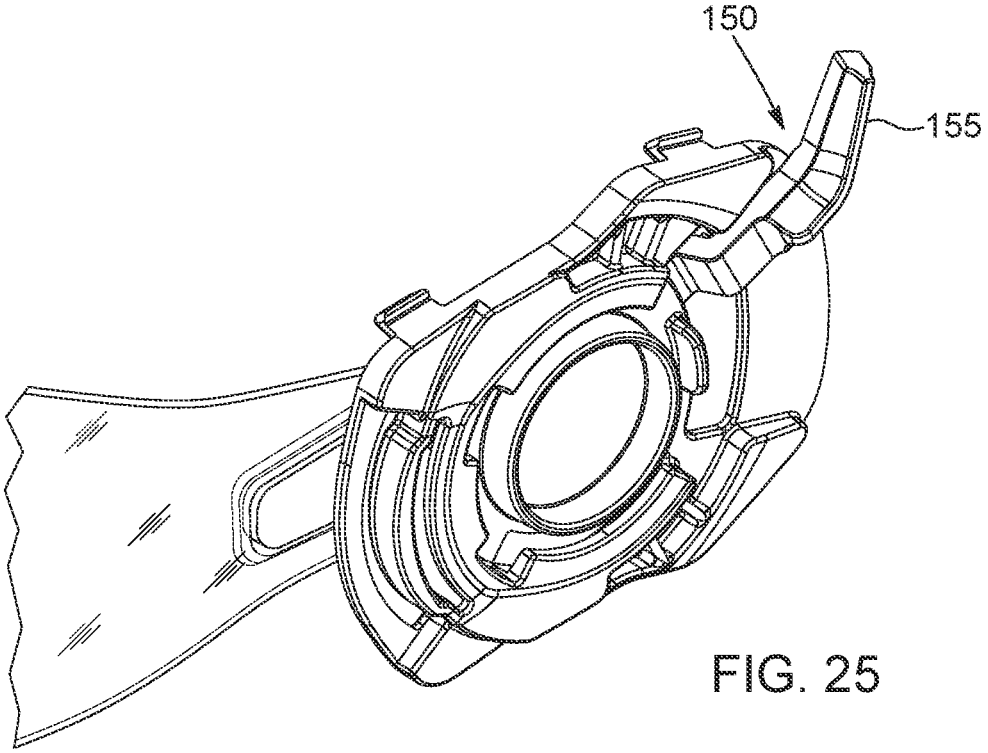
FIGS. 25 to 29 illustrate an alternate embodiment of the helmet and corresponding parts, such as the visor mounting sections and the visor actuator.
Figure 26:
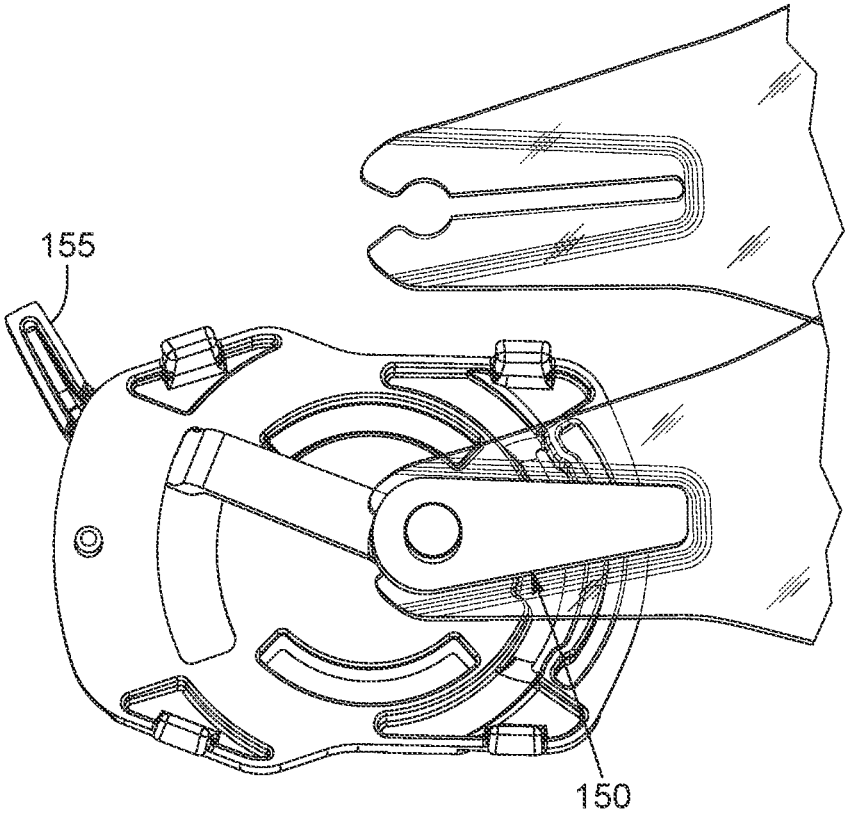
Figure 27:
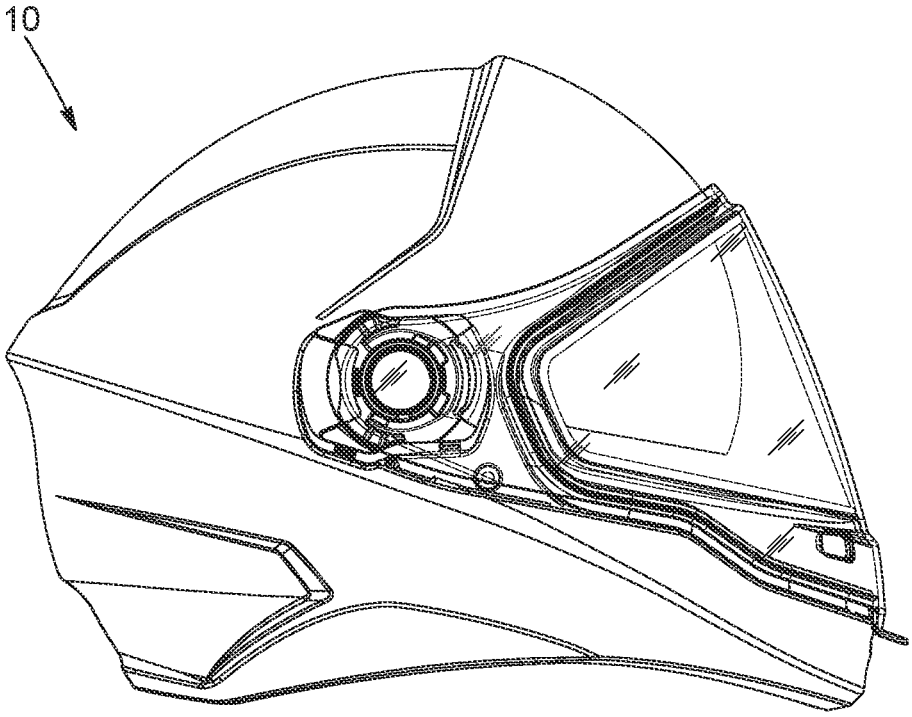
Figure 28:
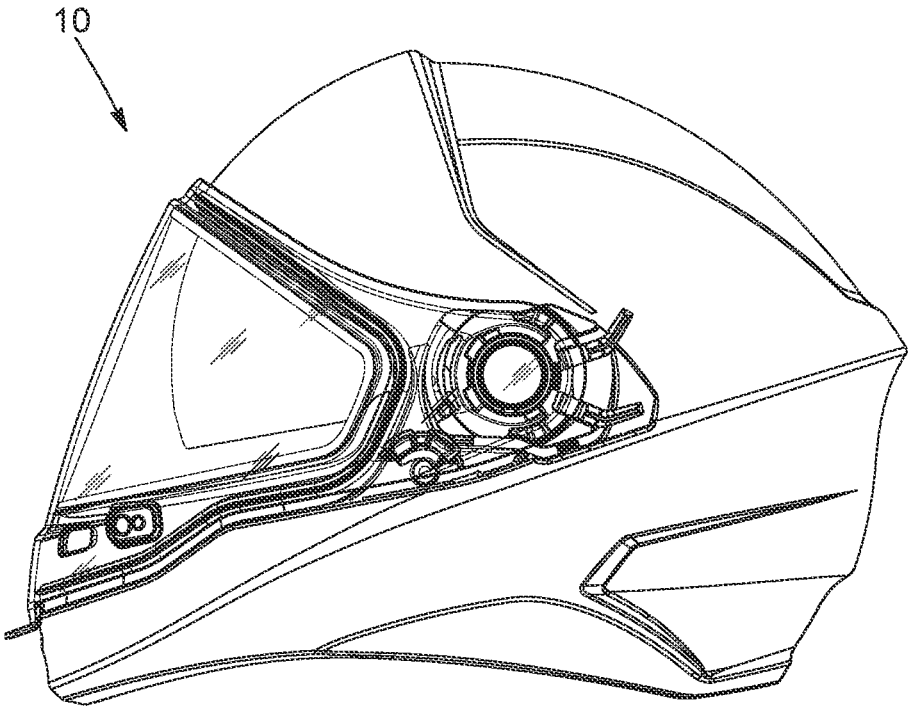
Figure 29:
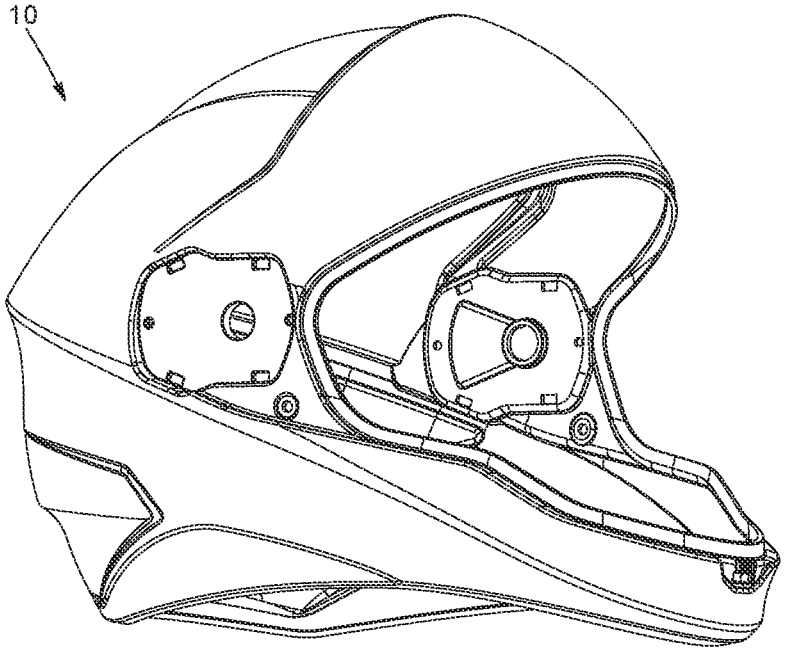

In order to enable movement of the visors, the mounting bases include pivots or pivot points. In some embodiments, the visor 30 (or "primary visor") is adapted to pivot about a first pivot 110 of the mounting bases 102, and the secondary visor 40 is adapted to pivot about a second pivot 120 of the mounting bases 102. More particularly, and with reference to FIGS. 8 and 9, the unitary body 104 includes the first pivot 110 which extends on a first side thereof, such as on the outer surface 107. The first pivot 110 defines a first pivot axis 112 about which the visor mounting sections 32 are adapted to rotate to move the visor 30 open and closed. Similarly, the unitary body 104 includes the second pivot 120 which extends on a second side thereof, such as on the inner surface 105. The second pivot 120 defines a second pivot axis 122 about which the secondary visor mounting sections 42 are adapted to rotate to move the secondary visor 40 open and closed. In this embodiment, the first and second pivot axes 112, 122 are substantially parallel and are not coaxial relative to one another. In other words, the first and second pivot axes 112, 122 are offset from one another on the unitary body. As seen in FIG. 24, the overall shape of the unitary body 104 can extend within a plane, with the first and second pivot axes being offset relative to one another within said plane. In this embodiment, the first and second pivot axes are offset relative to each other along the longitudinal axis (L) of the unitary body (i.e., offset along a length of the unitary body).

The visor 30 is pivotally connectable to the first pivot and is adapted to rotate between a closed position (seen in FIGS. 5 and 6), where the visor 30 covers a front opening of the helmet shell 12, and an open position (not shown), where the visor 30 is pivoted upwardly and over the helmet shell 12. In other words, the visor 30 is positioned along an outer periphery/surface of the helmet shell 12, and overlays the helmet shell 12 when in the open position. On the other hand, the secondary visor 40 is pivotally connectable to the second pivot and is positioned within the cavity of the helmet shell 12. The secondary visor 40 is adapted to rotate between a closed position (FIG. 3), where the secondary visor 40 is positioned behind the visor 30, and an open position (FIG. 4), where the secondary visor 40 is removed from behind the visor 30, but remains within the helmet shell 12. As seen in FIGS. 3 and 4, the helmet shell 12 and an internal component (e.g., a helmet liner) define an internal cavity 16 adapted to receive the secondary visor 40 when in the open position.

Figure 10:
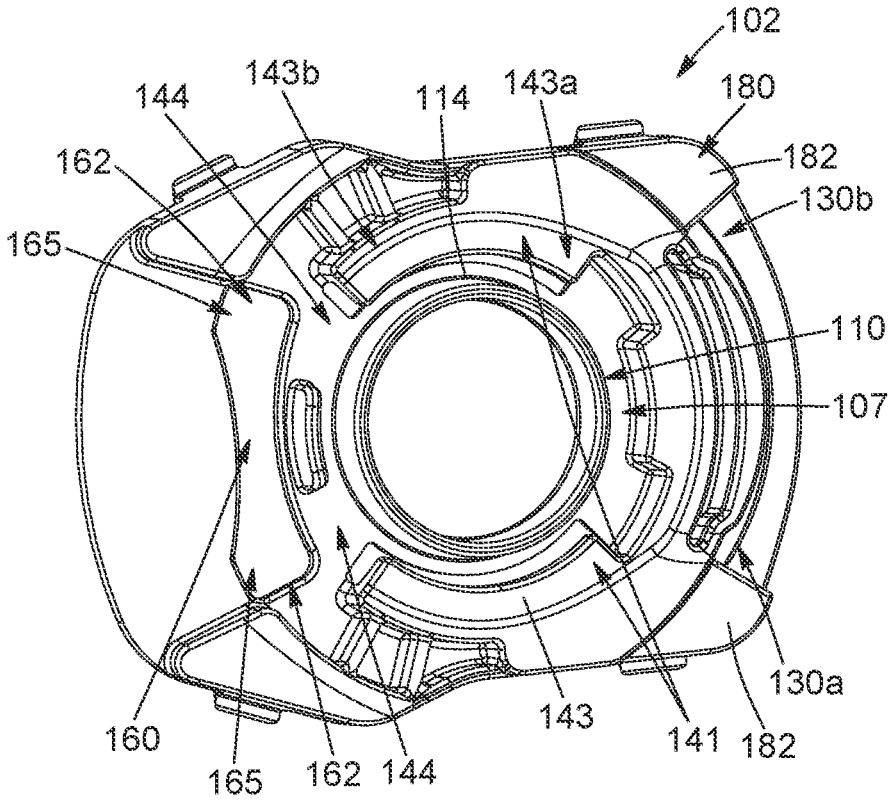
FIG. 10 is a top perspective view of the mounting base shown in FIG. 7, showing a first pivot, according to an embodiment.
Figure 11:
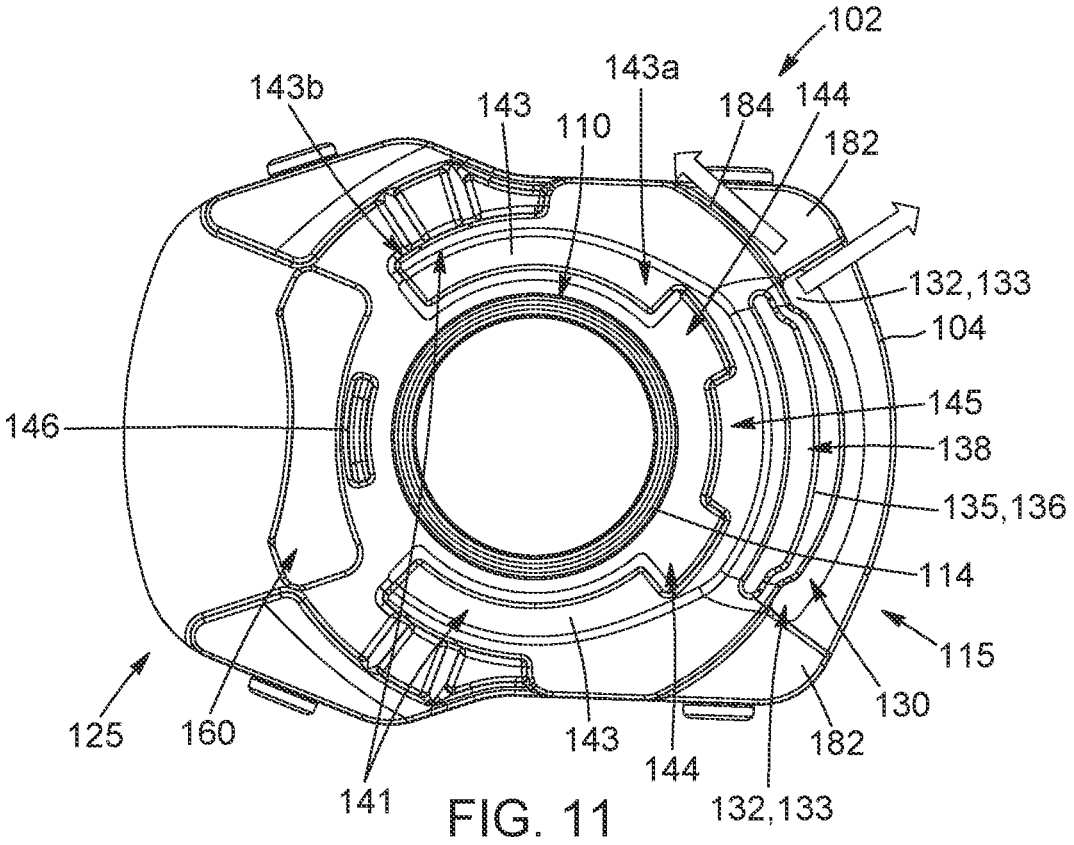
FIG. 11 is a top plan view of the mounting base shown in FIG. 10, showing a top surface of the mounting base, according to an embodiment.
Figure 12:
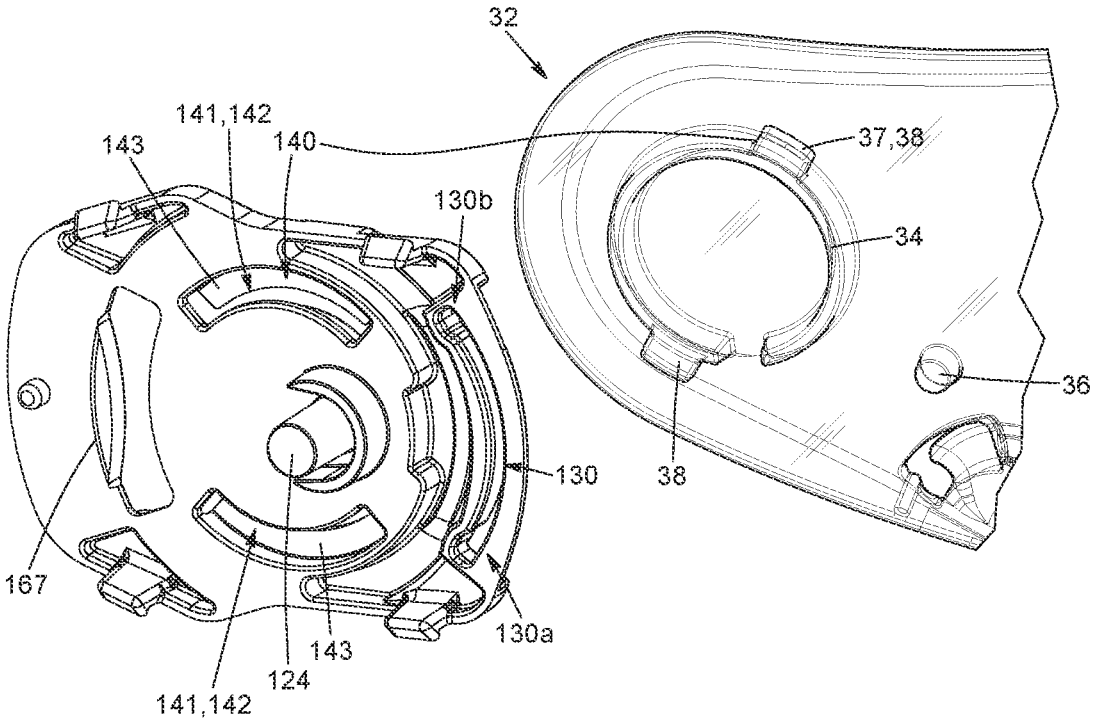
FIG. 12 is a perspective view of an end of the outer visor, showing an anchoring system of the mounting base, according to an embodiment.

In this embodiment, the first pivot 110 includes an outer flange 114 extending from the outer surface 107 of the unitary body 104 and adapted to engage and/or cooperate with a portion of the visor mounting section 32. As seen in FIGS. 10 to 12, in addition to FIGS. 7 and 8, the flange can be a circular flange 114, with the first pivot axis extending generally in the center of the circular flange 114. The visor mounting sections 32 can be provided with complementary portions for engagement with respective circular flanges 114. For example, in some embodiments, the visor mounting sections 32 each include an inner circular flange 34 complementarily shaped relative to the circular flange 114 to engage therewith. The inner circular flange 34 can be larger (e.g., have a greater diameter) than the circular flange 114 to enable the visor mounting section 32 to overlay the unitary body 104, and have the flanges 34, 114 engage one another to guide the rotational movement of the visor. It should be noted that, in other embodiments, the inner circular flange 34 can be smaller than the circular flange 114 to facilitate engagement and guide the rotational movement.

The circular flanges 34, 114 can be part of a guiding system configured to guide the rotational movement of the visor 30. In this embodiment, the guiding system can be further adapted to limit movement of the visor 30 in either direction, thereby defining fully-open and/or fully-closed configurations. With reference to FIGS. 10 to 12, the unitary body 104 can include a radial aperture 130 extending therethrough, and the visor mounting section 32 can include a protrusion 36 shaped and sized to engage and travel (e.g., slide) along the radial aperture 130, which can further guide the rotational movement of the visor. As seen in FIG. 12, the protrusion 36 can extend inwardly from the visor mounting section 32 (similar to the inner circular flange 34) to facilitate engagement with the radial aperture 130. In the illustrated embodiment, only one of the visor mounting sections 32 is provided with a protrusion 36, although other configurations are possible, such as both visor mounting sections 32 being provided with a protrusion 36, or one or both visor mounting sections 32 being provided with multiple protrusions 36, for example.

During movement of the visor 30, it is appreciated that the inner circular flange 34 rotates relative to the circular flange 114 of the first pivot 110, and that the protrusion 36 travels along the radial aperture 130 between opposite ends 130*a*, 130*b* thereof. It is thus noted that the ends 130*a*, 130*b* of the radial aperture 130 define rotational stops 132 configured to prevent further movement of the protrusion 36 along the radial aperture in a given direction. Rotational movement of the visor 30 is thereby limited, where the fully-open position corresponds to when the protrusion engages a first end of the radial aperture 130, and the fully-closed position corresponds to when the protrusion 36 engages a second end of the radial aperture 130. In some embodiments, the radial aperture 130 is generally concentric relative to the first pivot 110 (e.g., relative to the circular flange 114) to facilitate simultaneous movement of the inner circular flange about the circular flange, and of the protrusion along the radial aperture. It should be noted that the expression "concentric" can refer to elements sharing the same central point, and that the elements can be circular, elliptical, polygonal or have any other suitable shape to share a central point. The radial aperture 130 illustratively extends along a circumference of a circle or ellipsis which has the first pivot axis 112 as a central point, similar to the circular flange 114.

In this embodiment, the rotational stops 132 include recessed portions 133 defined at respective ends of the radial aperture 130 for receiving the protrusion 36 therein. As such, the protrusion 36 can be retained within the recessed portion 133 without having to hold (e.g., manually) the visor 30 in the desired position/configuration. Applying a rotational force to the visor (e.g., to open or close it) from the fully-open or fully-closed position can be sufficient to disengage the protrusion 36 from the recessed portion 133, thereby enabling movement of the visor 30. The visor can be further provided with a clip at a lower edge thereof configured to clip onto the helmet shell (e.g., at a bottom edge of the frontal opening) to assist in maintaining the visor in the fully-closed position.

In some embodiments, the unitary body 104 includes a biasing element 135 extending along at least a portion of the radial aperture 130, the biasing element 135 being adapted to generate a biasing force on the protrusion within the radial aperture. It is appreciated that the biasing force can be adapted to generate friction between the protrusion 36 and the sides (e.g., the lateral walls) of the radial aperture as the protrusion travels therealong. The generated friction can aid to control the visor when moving between the open and closed positions.

In this embodiment, the biasing element 135 includes a resilient runner 136 extending along the radial aperture 130. More particularly, the resilient runner 136 can define one of the lateral walls of the radial aperture 130. The resilient runner 136 can be configured to bias the protrusion toward the front section 115 of the unitary body, and thus toward the opposite lateral wall of the radial aperture. It is thus noted that the resilient runner can be configured, by a combination of its shape and the direction of the biasing force, to bias the protrusion toward and/or within the recessed portions, and assist in retaining the protrusion within the recessed portions 133 to hold the visor 30 in one of the fully-open and fully-closed positions. For instance, due to the arcuate shape of the resilient runner 136, as seen in FIG. 11, the biasing force generated and applied to the protrusion is directed toward a top recessed portion 133 when the protrusion is in a corresponding top portion of the radial aperture 130, and toward a bottom recessed portion when the protrusion is in a corresponding bottom portion of the radial aperture. In this embodiment, the top and bottom portions of the radial aperture can each correspond to respective halves of the radial aperture. However, it is appreciated that other configurations and features are possible for biasing and/or holding the protrusion within the recessed portions 133.

In some embodiments, the resilient runner 136 can be shaped and adapted to generate a varying biasing force depending on the position of the protrusion 36 along the radial aperture 130. For example, the "protrusion and resilient runner" assembly can generally correspond to a "cam and follower" mechanism, where the profiled shape of the resilient runner causes the protrusion to be biased (e.g., to move) in a certain direction via a given biasing force. In this embodiment, the shape of the resilient runner is configured to generate a greater biasing force, and thus greater friction/resistance proximate a center thereof (e.g., about at midpoint between the fully-open and fully-closed positions of the visor), thereby urging the protrusion upwardly or downwardly based on its position within the radial aperture. For instance, when the protrusion is slightly below the central point of the radial aperture, the biasing force urges the protrusion toward the bottom end 130*a* of the radial aperture 130, and when the protrusion is slightly above the central point of the radial aperture, the biasing force urges the protrusion toward the top end 130*b* of the radial aperture 130. It should thus be understood that the biasing force generated by the resilient runner is not constant along its length.

As seen in FIG. 11, the resilient runner 136 can be provided between the radial aperture 130, and a radial opening 138, each of which extends along the length of the resilient runner 136. The shape of the resilient runner defines a varying width of the radial aperture 130, where the width is narrower proximate the center due to a wider section of the resilient runner, and wider proximate opposite ends thereof due to a narrower section of the resilient runner. As such, the protrusion can be made to push against the resilient runner when the protrusion 36 travels through the center of the radial aperture. Then, due to its resilient nature, the resilient runner pushes back on the protrusion and generates the biasing force discussed above. The radial opening 138 defined opposite the radial aperture relative to the resilient runner can be adapted to enable some movement of the resilient runner as the protrusion travels from one end of the radial aperture to the other, for example.

Still with reference to FIGS. 10 to 12, in some embodiments, the mounting bases 102 can include an anchoring system 140 configured to selectively retain the visor mounting sections 32 in connection with the unitary bodies 104, thus retaining the visor 30 connected to the helmet shell 12. The anchoring system 140 can include two or more parts provided on one or more of the helmet shell, the mounting bases and/or the visor 30. For example, in some embodiments, the anchoring system 140 includes one or more visor anchors 37 positioned, connected to or otherwise defined on the visor 30, such as on the visor mounting sections 32. The anchoring system 140 includes corresponding anchor retaining profile(s) 141 defined on the unitary bodies 104 of the mounting bases 102 for receiving the visor anchors 37 therein. The anchor retaining profile 141 can be elongated and adapted to enable movement of the visor anchors 37 therealong while preventing movement of the anchors 37 away from the unitary body (e.g., radially away from the unitary body). As such, rotational movement of the visor 30 remains unobstructed by the anchoring system 140, and the visor mounting sections 32 remain at least partially secured to respective mounting bases 102. As will be described below, the visor mounting sections 32 can be uncoupled from the unitary bodies. Therefore, it should be understood that the visor anchors 37 can be disengaged from the anchor retaining profiles, thereby enabling disconnection of the visor 30 from the mounting bases and the helmet shell.

In this embodiment, the visor anchors 37 include one or more projections 38 extending on the inner surface of the visor mounting sections 32. As seen in FIG. 12, the visor anchors 37 include a pair of projections 38 radially extending from the inner circular flange 34 generally opposite one another. However, it is appreciated that other configurations of the projections are possible, such as any other suitable number of radial projections, positioned at various other locations, for example. The anchor retaining profile 141 includes anchor channels 142 defined along the mounting base and along which the visor anchors 37 can move during operation of the visor (e.g., during movement between the open and closed positions). In other words, the projections 38 are adapted to slidably engage the anchor channels 142 to at least partially prevent disengagement of the visor mounting sections 32 from the unitary body.

In some embodiments, the anchor channels 142 are each defined by an overhang 143 extending from and above the outer surface of the unitary body. It is thus noted that the visor anchors 37 can be adapted to slidably engage the anchor channel beneath the overhang 143. The overhangs therefore extend over and cover the visor anchors 37, thereby preventing disengagement of the visor mounting sections 32 from the unitary body 104. The overhangs 143 can have any suitable shape or size, and can extend generally parallel relative to the outer surface 107.

It is noted that the visor anchors 37 are adapted to slide along a length of the anchor channels 142 during rotational movement of the visor 30. In this embodiment, the anchor channels 142 include a pair of anchor channels 142 extending opposite one another about the first pivot 110. The anchor channels 142 are provided about and concentric with the first pivot 110 (e.g., around the circular flange 114). It is thus appreciated that the circular flange 114, the radial aperture 130 and the anchor channels 142 are concentric relative to one another so as to not hinder the rotational movement of the visor 30. As seen in FIG. 11, the anchor channels 142 and the overhangs 143 are concentrically positioned between the radial aperture 130 and the first pivot 110. In other words, the distance between the center point (e.g., the first pivot axis 112) and the radial aperture 130 is greater than the distance between the center point and the overhangs 143, which is in turn greater than the distance between the center point and the circular flange 114.

The visor mounting sections 32 can be removably connected to the mounting bases 102, with the visor anchors 37 being adapted to disengage the anchors channels 142 to permit said disconnection. The anchoring system 140 can include one or more anchor channel openings 144 communicating with the anchor channels 142. The anchor channel openings 144 are adapted to enable connection and disconnection of the visor anchors 37 (e.g., the projections 38) with the anchor channels 142. More particularly, in this embodiment, the projections 38 can be inserted into the anchor channel openings 144, and slid under the overhangs 143. In the embodiment of FIGS. 10 and 11, the anchoring system 140 includes four (4) anchor channel openings 144, and more particularly include two pairs of anchor slot openings, where each pair includes two anchor channel openings 144 provided opposite each other about the circular flange 114. It is thus noted that the pair of oppositely positioned projections 38 can be inserted into respective ones of a given pair of anchor channel openings 144.

The anchoring system 140 can further include walls adapted to define the anchor channel openings 144 on the corresponding surface of the unitary body. The walls are therefore provided in a spaced-apart relation with at least one of the overhangs 143 to define the anchor channel opening 144 therebetween. In this embodiment, the walls include a front wall 145 provided between front ends **143*a* of the overhangs 143 to define the the anchor channel openings 144 on a front-facing side of the circular flange 114. The walls can further include a rear wall 146 provided between rear ends 143*b* of the overhangs 143 to define the the anchor channel openings 144 on a rear-facing side of the circular flange 114. In some embodiments, further to defining the anchor channel openings 144, the walls can be adapted to limit rotation of the visor. More particularly, the projections 37 are adapted to abut against the walls of the anchoring system 140**, thereby blocking further rotation in a given direction. In some embodiments, at least one of the fully-open and fully-closed configurations corresponds to when the projections abut the walls, although other configurations are possible.

In some embodiments, when in the fully-open position, the projections are aligned with a pair of anchor channel openings 144 to enable disconnection of the anchors 37 from the mounting base. It should be noted that the visor 30 can be made of resilient and/or flexible material, such that, if the visor is further pushed upwardly (e.g., when in the fully-open configuration), the visor mounting sections 32 are urged inwardly on either sides of the helmet. As such, the protrusions 36 are retained within respective radial apertures, thereby preventing inadvertent disconnection of the visor (e.g., by urging the visor upwardly when already open). As such, simply urging the visor upwardly is not sufficient to disconnect the visor from the mounting base.

It is further noted that the visor 30 can be shaped and configured such that the visor mounting sections 32 are urged, or otherwise biased toward one another when in (or close to) the fully-open and/or fully-closed positions. As such, the protrusions 36 are urged inwardly and within respective radial apertures, further securing the visor mounting sections to the mounting bases. For example, the visor mounting sections can define a composite angle therebetween comprising a combination of a camber angle (seen in FIG. 36) and a toe angle (seen in FIG. 37). The composite angle can cause the visor mounting sections 32 to move toward one another when moving the visor in or toward the fully-open and/or fully-closed positions, for example.

Figure 36:
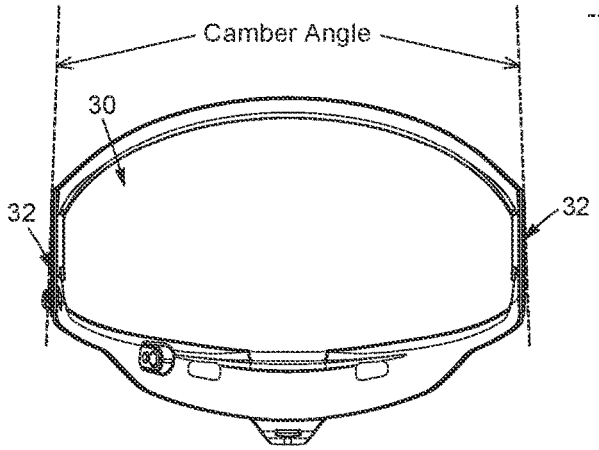
FIGS. 36 and 37 are front and top views of the outer visor, showing a camber angle (FIG. 36) and a toe angle (FIG. 37) of a structure of the outer visor, according to an embodiment.
Figure 37:
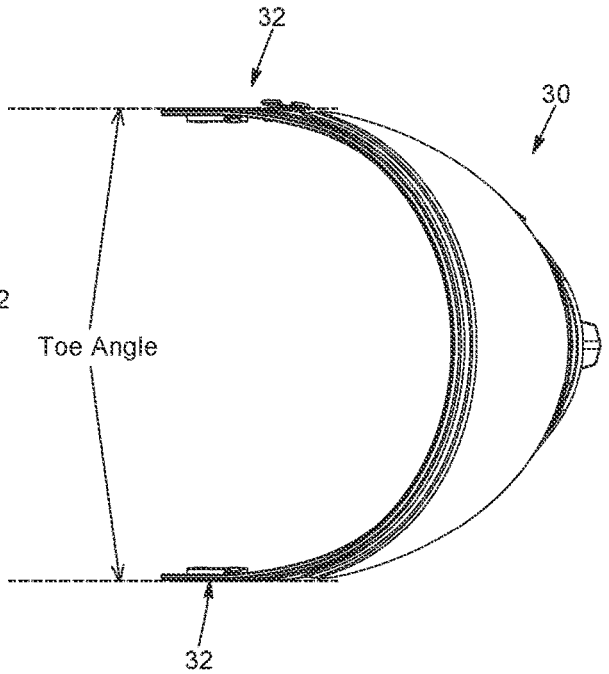

It should be understood that, as used herein, and with reference to FIGS. 36 and 37, that the expression "camber angle" can refer to the angle defined between the vertical axis of a given mounting section 32 (e.g., an axis defined in the plan defined by the surface of the mounting section) and the vertical axis of the visor (e.g., the centerline) when viewed from the front or rear. In a similar fashion, it should be understood that the expression "toe angle" can refer to the direction toward which the mounting sections 32 extend, in relation to the visor centerline when viewed from above.

In the illustrated embodiments, from the fully-open configuration, the protrusions 36 can be removed, for example, by hand, from their radial apertures. It should be understood that, as used herein, the expression "by hand" can refer to an action (e.g., removing the protrusions from their radial apertures) performed without the use of tools, equipment or additional pieces of the helmet and/or visor mounting system. However, it is appreciated that, although not necessary, tools can be used to remove the visor from the helmet shell. Removal of the protrusions 36 from the radial apertures is enabled due to the alignment of the projections 38 with the anchor channel openings 144, as described above, which permits moving the visor mounting sections 32 away from the mounting bases 102. Once the protrusions are clear from respective radial apertures and any surrounding structure of the unitary body, the visor 30 becomes disconnected from the helmet shell, and can be removed.

In some embodiments, and as seen in FIGS. 10 and 11, the mounting base 102 can include a retainment mechanism 180 configured to prevent accidental or otherwise unwanted disconnection of the protrusions from within their radial apertures 130. The retainment mechanism 180 can include a raised portion 182 of the unitary body 104 proximate at least one of the ends 130*a*, 130*b* of the radial aperture 130. Once each of the protrusions is positioned at either end of its radial aperture, the visor can be deformed (e.g., manually) to separate the visor mounting sections from the mounting bases. In other words, the visor can be deformed to remove the protrusions from respective radial apertures.

It is noted that, in order to enable removal of the protrusion from the radial aperture, the protrusion has to clear the raised portion 182 of the retainment mechanism. As such, in this embodiment, deforming the visor to separate the visor mounting sections from the mounting bases includes raising the protrusions out of their radial apertures, and over the raised portions 182. Once above the raised portions 182, the visor can be further rotated, and subsequently removed. For instance, when the protrusion is positioned in the recessed portion 133 at the top end 130*b* of the radial aperture 130, the visor mounting section can be manually deformed to raise the protrusion over the raised portion 182, enabling further rotation of the visor upwardly. The retainment mechanism 180 can include guiding surfaces 184 defined along the raised portion 182 to assist the rotational movement of the visor once the protrusions are disengaged from the radial apertures. In some embodiments, the guiding surfaces 184 can be a continuation of a portion of the resilient runner 136, although other configurations are possible.

It should be noted that the flexible and/or resilient nature of the visor 30 facilitates the removal of the protrusions from the radial apertures by allowing the visor mounting sections to be moved away from the helmet shell (i.e., away from the mounting base/unitary body). In other words, the visor 30 can be bent and/or flexed to disconnect the visor mounting sections 32 from the mounting bases. It should be further noted that, in the illustrated embodiments, the projections 38 are adapted to remain at least partially covered by the overhangs 143 when the visor is in the fully-open position (e.g., when the protrusion abuts the top end of the radial aperture). Raising the protrusion over the raised portion 182, and further rotating the visor upwardly allows the projections 38 to line up with the anchor channel openings 144, thereby enabling disconnection of the visor mounting section from the mounting base, and removal of the visor.

It should be understood that the installation of the visor can substantially include the same steps as described above, but in a reverse order. For example, the visor can be deformed by spreading the visor mounting sections away from one another in order to position the protrusions over the raised portions 182. The protrusions can also be positioned in abutment with the guiding surface 184, thereby aligning the protrusions with their respective radial apertures. The projections 38 are simultaneously inserted into a corresponding pair of anchor channel openings 144, and the visor can then be rotated downwardly, causing the protrusions to slide along the guiding surfaces. The visor is rotated downwardly, causing the projections 38 to slide beneath the overhangs 143 until the protrusions reach a threshold between the raised portion 182 and the radial aperture. At this point, it should be understood that further downward rotation of the visor causes the protrusions to fall into their corresponding radial aperture due to the shape and resilient nature of the visor (e.g., the visor mounting sections "snaps" into position as the protrusions engage the radial apertures). The visor is then connected to the mounting bases and can be moved open and closed, as described above.

With reference to FIGS. 5, 6, 9, 13 and 14, the secondary visor 40 can also be removably and pivotally connected to the mounting bases 102. More specifically, the secondary visor 40 is adapted to rotate about the second pivot 120, and thus about the second pivot axis 122. In some embodiments, the second pivot 120 includes an inner protrusion 124 extending from the inner surface 105 of the unitary body 104. The visor mounting sections 42 can be provided with one or more openings 44 (FIG. 19) shaped and adapted to receive the inner protrusions 124 therein and enable rotational movement of the secondary visor 40 about the inner protrusions 124.

Figure 9:
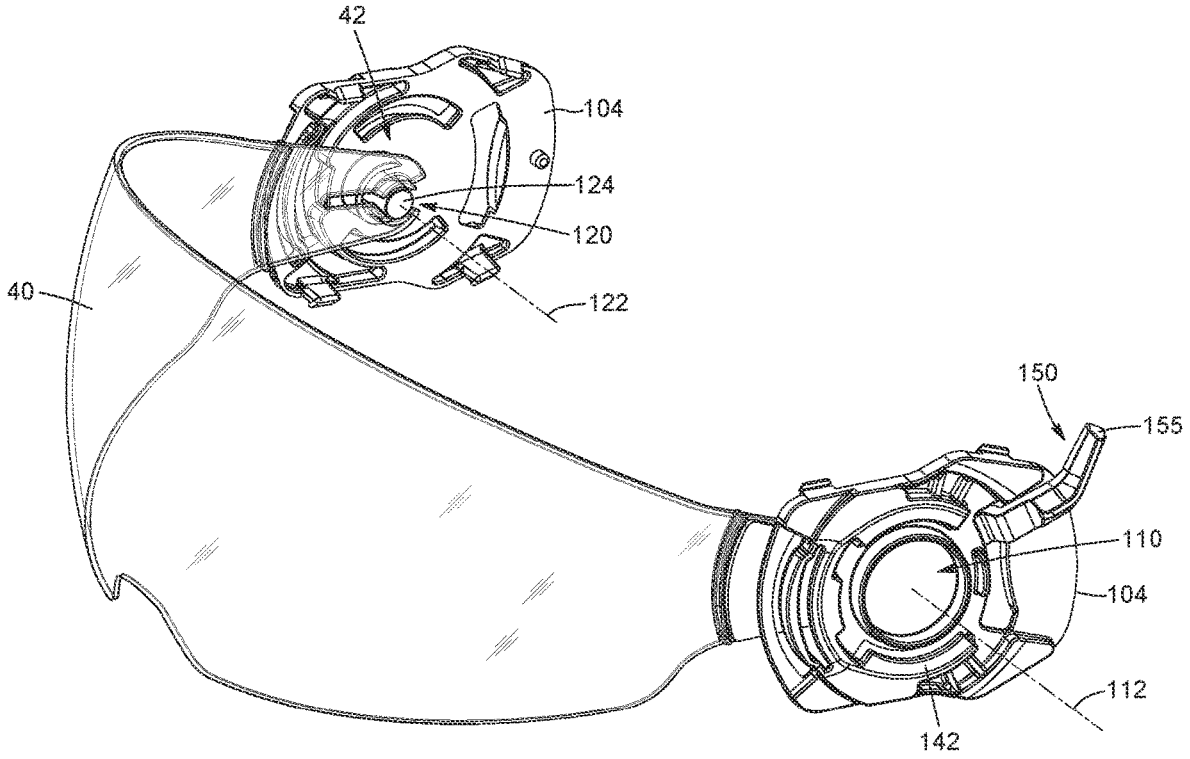
FIG. 9 is a perspective view of the inner visor of the helmet according to an embodiment, showing a pair of mounting bases coupled at opposite ends thereof.

In this embodiment, the inner protrusions 124 are generally cylindrical and thereby extend along a longitudinal axis. It is noted that the longitudinal axis of each one of the inner protrusions 124 is aligned with the second pivot axis 122 of the corresponding unitary body, as seen in FIG. 9, for example. Referring back to FIGS. 5 and 6, it is noted that the secondary visor 40 is positioned inwardly relative to the visor 30 (i.e., behind the visor 30 within the helmet shell 12). Therefore, in order to manually open and/or close the secondary (or inner) visor 40, the primary (or outer) visor 30 can be required to be at least partially open to enable access to the inner visor 40. However, in some embodiments, the secondary visor 40 includes a secondary visor actuator 150 pivotally connectable to either one of the mounting bases 102, or to each mounting base 102, and configured to be coupled to at least one of the secondary visor mounting sections 42. As will be described, the secondary visor actuator 150 is operable to open and close the secondary visor 40 from outside the helmet shell 12. Although described in relation to the secondary visor 40, it should be noted that the secondary visor actuator 150 can be used in relation with the visor 30, either in addition to being used for the secondary visor 40, or as an alternative thereto.

Now referring to FIGS. 15 to 22, the secondary visor actuator 150 is operatively coupled to one of the mounting bases 102 and is adapted to be connected to the corresponding secondary visor mounting section 42. More specifically, in some embodiments, the secondary visor 40 includes a first mounting section 42 which pivotally connects to the inner protrusion 124 of a first mounting base 102, and a second mounting section 42 which connects to the secondary visor actuator 150. In other words, the secondary visor 40 can include an actuated mounting section 46 engageable with the secondary visor actuator 150 which is coupled to one of the unitary bodies 104. The secondary visor further includes a support mounting section 48 pivotally connected to the other one of the unitary bodies 104. The secondary visor actuator 150 is adapted to be selectively operated (e.g., manually moved/pivoted) to open and close the secondary visor.

As seen in FIGS. 15 to 18, the secondary visor actuator 150 includes an inner portion 151 pivotally connected to the inner protrusion 124, and an outer portion 153 which is manually operable from outside the helmet. In this embodiment, the inner portion includes an actuator tab 152 pivotally connectable to the inner protrusion 124 and to which the actuated mounting section 46 is connected. The actuator tab 152 can taper outwardly from the inner protrusion 124 such that a distal end thereof is wider than a proximal end, although other configurations are possible. The actuator tab 152 can include a slot 154 defined in a distal surface thereof shaped and adapted to receive the actuated mounting section 46 therein for connection therewith. In some embodiments, and as will be described below, the secondary visor actuator 150 and the actuated mounting section 46 are adapted to be selectively and removably interlocked with one another.

Figure 19:
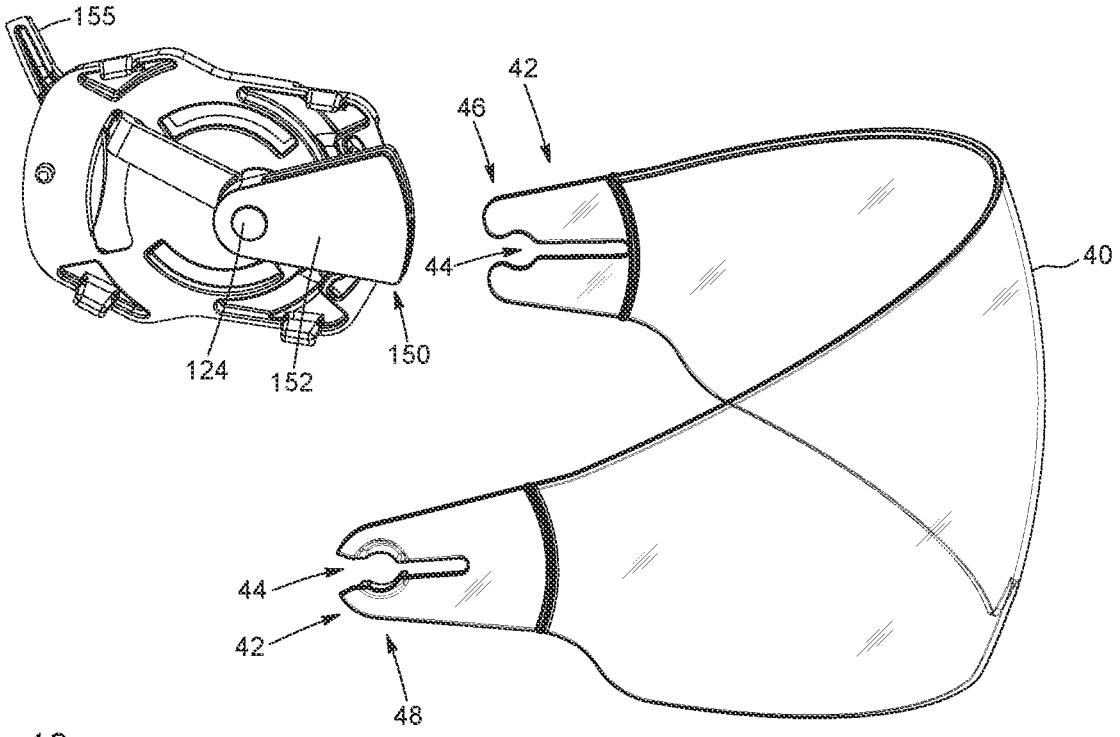
FIG. 19 is a partially exploded perspective view of the mounting base shown in FIG. 16 and the inner visor, showing a secondary visor mounting section connectable to the handle, according to an embodiment.
Figure 20:
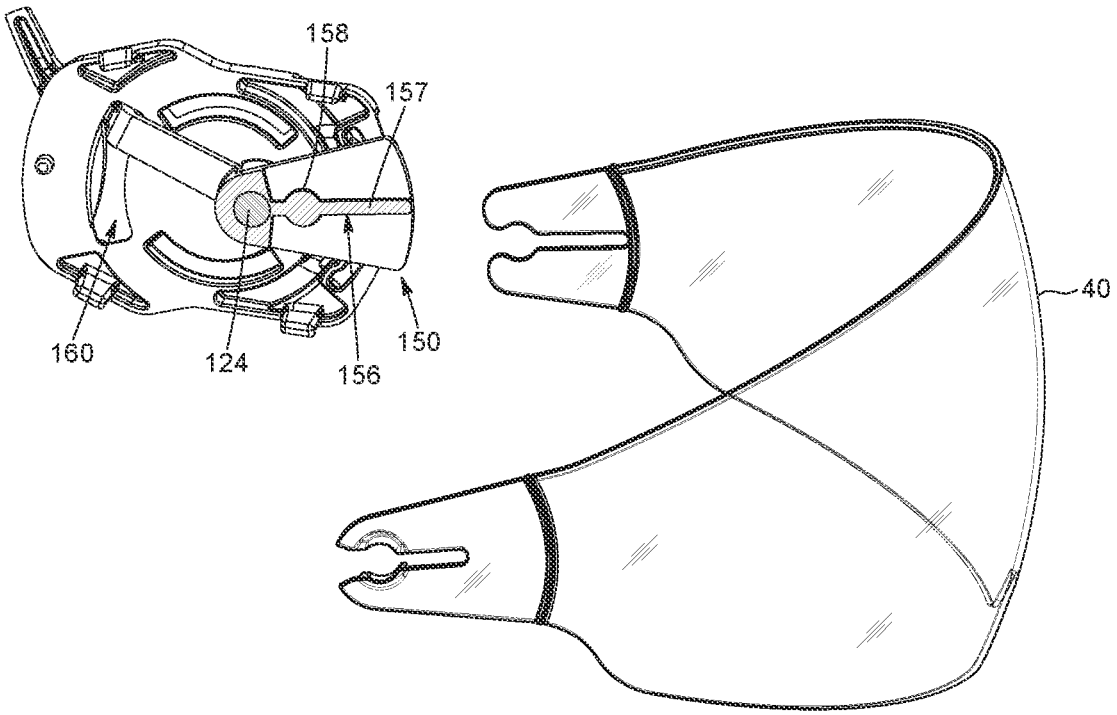
FIG. 20 is a partially exploded perspective view of the mounting base shown in FIG. 16 and the inner visor, showing a guiding rail of the handle complementarily shaped relative to the secondary visor mounting section, according to an embodiment.

With reference to FIGS. 19 and 20, in addition to FIGS. 15 to 18, the actuator tab 152 can include an internal structure configured to facilitate connection and/or enable securing the actuated mounting section 46 within the slot 154. For example, the actuator tab 152 can include a guiding rail 156 positioned within the slot 154. More specifically, and as seen in FIG. 20, the guiding rail 156 can include an elongated segment 157 extending radially relative to the inner protrusion 124, thereby separating the surface area of the slot 154 generally in halves. The opening 44 of the actuated mounting section 46 is illustratively elongated and adapted to enable sliding the mounting section onto the guiding rail 156. The guiding rail 156 can further include a stud 158 provided at a proximal end of the elongated segment 157 (e.g., proximate the inner protrusion 124). The opening 44 of the actuated mounting section 46 is similarly provided with an interlocking section, or enlarged section 45, configured to connect to the stud 158. In some embodiments, the actuated mounting section 46 clips, interlocks or snaps onto the guiding rail 156 for connection with the actuator tab 152, although other methods of connection are possible.

In the illustrated embodiment, the support mounting section 48 can also be provided with an elongated opening 44 provided with an enlarged section. As seen in FIG. 9, the enlarged section can be adapted to accommodate and receive the inner protrusion of the corresponding unitary body 104 and enable rotation of the support mounting section 48.

Referring back to FIGS. 10,11 and 15 to 18, the unitary body 104 can include a second radial aperture 160 defined through a thickness thereof. The second radial aperture 160 being adapted to enable the secondary visor actuator 150 to extend form the inner side of the unitary body to the outer side. As mentioned, the actuator tab 152 is connected to the inner protrusion 124 and is thus installed on the inner side. The visor actuator 150 further includes a handle 155 connected to and extending from the actuator tab 152 and through the second radial aperture 160 so as to be accessible from the outside of the helmet. It should thus be appreciated that the handle 155 is manually operated (e.g., moved) to move the secondary visor 40 open and closed. As illustrated, the handle 155 can be moved between opposite ends of the second radial aperture 160 by sliding therealong when operated, for example.

In this embodiment, during movement of the secondary visor 40, it is appreciated that the visor actuator 150 rotates relative to the inner protrusion 124 of the second pivot 120, and that the handle 155 slides or travels along the second radial aperture 160 between opposite ends thereof. It is thus noted that the ends of the second radial aperture 160 define rotational or radial stops 162 configured to prevent further movement of the handle 155 along the second radial aperture in a given direction. Rotational movement of the secondary visor 40 is thereby limited, where the fully-open position corresponds to when the handle engages a first end of the second radial aperture 160, and the fully-closed position corresponds to when the handle 155 engages a second end of the second radial aperture 160. In some embodiments, the second radial aperture 160 is generally concentric relative to the second pivot 120 (e.g., relative to the inner protrusion 124) to facilitate simultaneous movement of the actuator tab 152 about the inner protrusion, and of the handle 155 along the second radial aperture.

In this embodiment, the radial stops 162 each include a radial recess 165 defined at respective ends of the second radial aperture 160 for receiving part of the handle 155 therein. As such, the handle 155 can be retained within the radial recesses without having to hold (e.g., manually) the secondary visor 40 in the desired position/configuration. Applying a rotational force to the handle can be sufficient to disengage the handle 155 from the radial recesses and enable movement of the secondary visor 40. It should also be noted that any forces applied to the handle 155 can be at least partially transferred to the positional pin 108 of the unitary body 104 engaged in the positional aperture of the helmet mounting section, thus reducing stress on other parts of the mounting base 102 which can prevent damages, collapse and/or breaks.

As seen in FIGS. 13 to 18, in some embodiments, the unitary body 104 further includes an actuator biasing element 166 extending along at least a portion of the second radial aperture 160, the actuator biasing element 166 being adapted to generate a biasing force on the handle 155 within the second radial aperture. It is appreciated that the biasing force can be adapted to generate friction between the handle 155 and the sides (e.g., the lateral walls) of the second radial aperture as the handle travels therealong. The generated friction can aid to control the secondary visor when moving between the open and closed positions.

In this embodiment, the actuator biasing element 166 includes a curved walls 167 extending opposite each other along the second radial aperture 160. The curved walls 167 can be configured to generate a biasing force to bias the handle toward the ends of the second radial aperture. It is thus noted that the curved walls 167 can be configured, by a combination of their shape and the direction of the biasing force, to bias the handle toward and/or within the radial recesses 165, and assist in retaining the handle within the radial recesses 165 to hold the secondary visor 30 in one of the fully-open and fully-closed positions or in any other suitable positions. However, it is appreciated that other configurations and features are possible for biasing and/or holding the handle (or other portion of the actuator 150) in a desired position and/or configuration.

In some embodiments, the actuator biasing element 166 can be shaped and adapted to generate a varying biasing force depending on the position of the handle along the second radial aperture 160. For example, the profiled shape of the curved walls 167 can cause the handle to be biased (e.g., to move) in a certain direction via a given biasing force. In this embodiment, the shape of the curved walls 167 is configured to generate a greater biasing force, and thus greater friction/resistance proximate a center of the second radial aperture (e.g., about at midpoint between the fully-open and fully-closed positions of the secondary visor), thereby urging the handle upwardly or downwardly based on its position within the second radial aperture. For instance, when the handle is slightly below the central point of the second radial aperture, the biasing force urges the handle toward the bottom end of the second radial aperture, and when the handle is slightly above the central point of the second radial aperture, the biasing force urges the handle toward the top end of the second radial aperture. It should thus be understood that the biasing force generated by the curved walls of the actuator biasing element 166 is not constant along its length.

Figure 21:
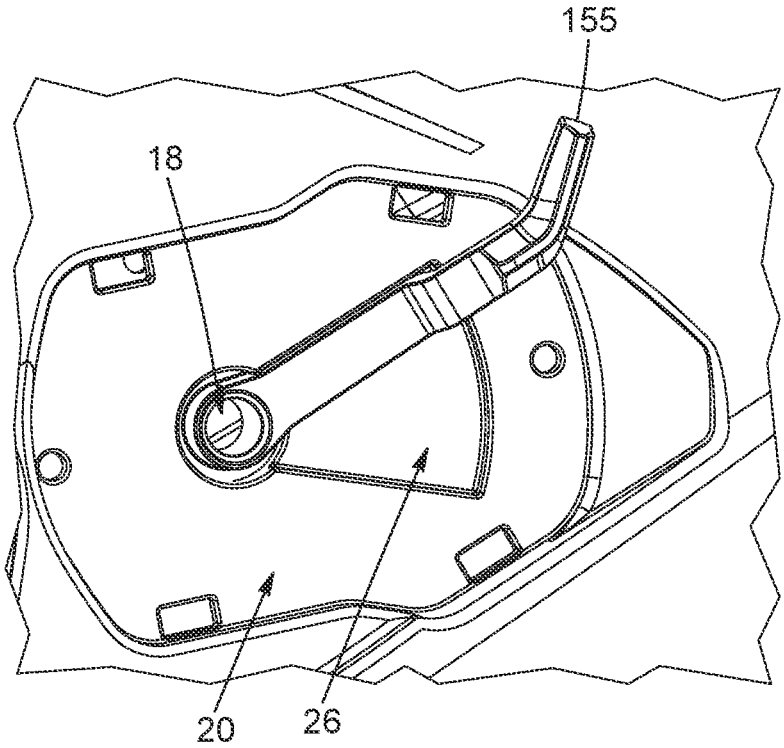
FIGS. 21 and 22 are side views of the helmet shell shown in FIG. 4, showing the handle extending therethrough in the first configuration (FIG. 21) and in the second configuration (FIG. 22).
Figure 22:
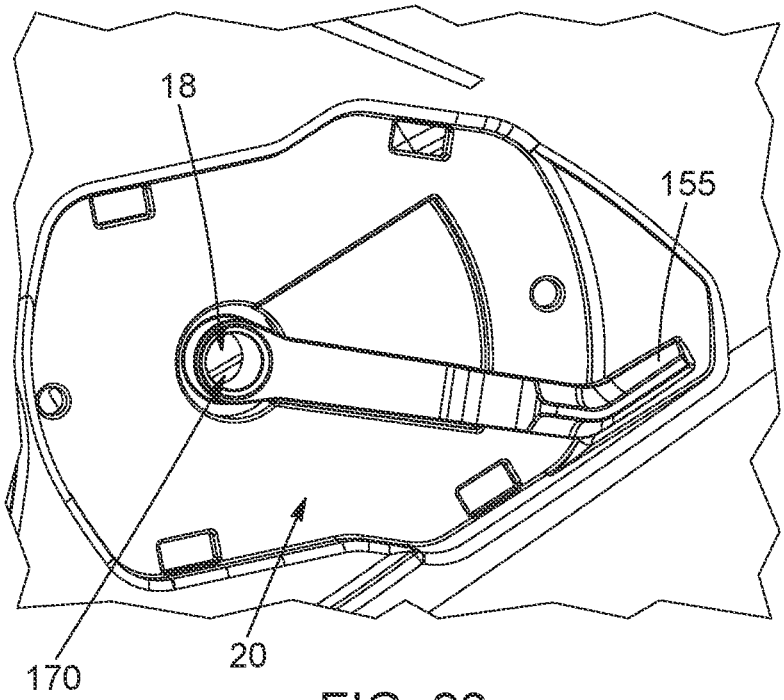
Figures 23, 23A:
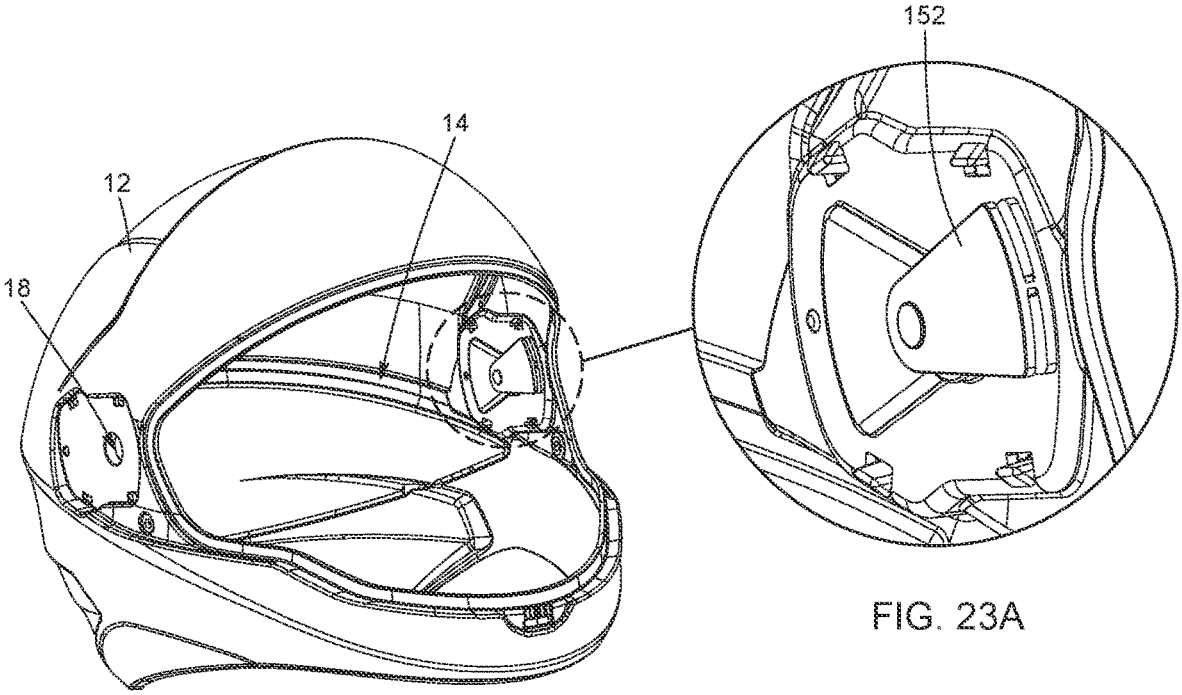
FIG. 23 is a perspective view of the helmet shell shown in FIG. 3, showing an actuator tab of the handle coupled to the helmet, according to an embodiment.
FIG. 23A is an enlarged view of the actuator tab shown in FIG. 23.

Now referring to FIGS. 21 and 22, at least one of the helmet mounting sections 20 can be adapted to accommodate and/or cooperate with the visor actuator 150. In this embodiment, the helmet mounting section 20 includes a guiding section 26 defined in a thickness of the helmet shell 12. The guiding section 26 being shaped and sized to receive at least a portion of the handle 155, and guide and/or limit movement of the handle 155 during operation of the visor actuator 150, for example, as the handle is manipulated to rotate the secondary visor. The guiding section 26 can be generally arcuate to enable and guide the rotational, or pivoting movement of the handle 155. As seen in FIGS. 23 and 23A, the actuator tab 152 is adapted to be positioned within the helmet shell 12, whereas the handle 155 (FIGS. 21 and 22) extends from the actuator tab 152 and through a shell opening 18 defined through the helmet shell 12 and within the helmet mounting section 20 (e.g., in the arcuate guiding section 26).

In some embodiments, the visor actuator 150 is placed in position prior to connecting the mounting base 102 to the helmet mounting section 20. More specifically, from within the helmet shell 12, the handle 155 is inserted through the shell opening 18 and the hole in the actuator tab 152 is aligned with the shell opening 18. The mounting base 102 can then be connected to the helmet mounting section 20, which includes inserting the inner protrusion 124 through the shell opening 18 for coupling with the actuator tab 152. The handle is illustratively provided with a proximal opening 170 at a base thereof to permit the inner protrusion 124 to extend therethrough and within the helmet shell 12. The mounting base 102 is therefore superposed to a portion of the handle 155 (e.g., the portion of the handle within the arcuate guiding section 26) and secured to the helmet shell 12, thereby securing the visor actuator 150 in place.

Although the visor actuator 150 was described as being connectable to one of the mounting bases 102, it should be noted that the visor actuator 150 can be adapted to be connected to either one of the mounting bases 102. Further, in other embodiments, the visor mounting system 100 can include additional visor actuators 150 coupled to one or both of the mounting bases, and to one or both of the visors.

As seen in FIGS. 10 and 11, in this embodiment, the radial recesses 165 of the second radial aperture 160 can extend radially outwardly and away from the second pivot 120, whereas the recessed portions 133 of the radial aperture 130 can extend radially inwardly and toward the first pivot 110. Moreover, in this embodiment, the radial aperture 130 is defined across a portion of the unitary body 104 proximate a front section thereof, whereas the second radial aperture 160 is defined across a portion of the unitary body 104 proximate a rear section thereof. However, it should be noted that other configurations of the radial apertures 130, 160, as defined on the unitary body 104, are possible.

Referring broadly to FIGS. 1 to 24, it is appreciated that, for the same piece/part (e.g., the unitary body 104 of the mounting base 102) to be connectable to both sides of the helmet shell in respective orientations, the helmet mounting sections 20 are asymmetric relative to one another. More particularly, and as seen in FIGS. 3 and 4, the outer periphery of the helmet mounting sections 20*a*, 20*b* can be substantially identical, but other features can differ from one another, such as the arcuate guiding section 26, for example. Similarly, the visor mounting sections 32 of the visor 30 can be asymmetric relative to one another to enable connection with identical mounting bases 102 which are connected to the helmet shell in respective orientations.

In some embodiments, to connect the visor mounting system to the helmet shell, the visor actuator is initially inserted through the shell opening 18 defined within at least one of the helmet mounting sections. Then, the mounting base is installed, on the same side as the visor actuator, by passing the handle through the second radial aperture, and the protrusion through the shell opening 18 to engage the actuator tab within the cavity. The mounting base is then connected to the helmet shell via the snap-fit connection, thereby securing the visor actuator to the helmet shell while allowing its rotation. The visor and/or the secondary visors can then be connected to the mounting base and/or the visor actuator.

In some embodiments, the visor actuator is installed only on one side of the helmet shell, with the second side being provided with only a mounting base to which at least one of the visor and secondary visor is pivotally coupled. However, it is appreciated that other embodiments are possible, such as having a pair of visor actuators on either side of the helmet, for example. Moreover, it should be noted that the secondary visor can be optional, and that the visor actuator is thus unnecessary. As such, the method for connecting the visor to the helmet shell includes connecting a first mounting base to the helmet shell, on a first side thereof, connecting a second mounting base to the helmet shell, on a second side thereof, and pivotally connecting the visor to both mounting bases.

FIGS. 25 to 29 illustrate an alternate embodiment of the helmet 10 and corresponding parts, such as the visor mounting sections and the visor actuator.

It should be appreciated from the present disclosure that the various embodiments of the helmet, visor mounting system and related components enable the visor to be connected and manipulated in a desired configuration by the use of a single component made of a single piece, such as the unitary body of the mounting base. The unitary body is therefore identical on both sides of the helmet, but is adapted to be connected thereto in respective orientations. The unitary body provides two pivot points about which respective visors are configured to rotate. The pivot points define pivot axes which are not aligned with one another to allow an inner visor to pivot within the helmet shell, and allow an outer visor to pivot outside of the helmet shell. The inner visor is also adapted to connect to a first side of the unitary body while the outer visor connects to a second side of the unitary body. In other words, the mounting base is positioned between the inner and outer visors. Finally, with the addition of the visor actuator, it is noted that a two-piece assembly coupled to the helmet shell enables operation of the inner visor from an exterior of the helmet shell.

Figure 30:
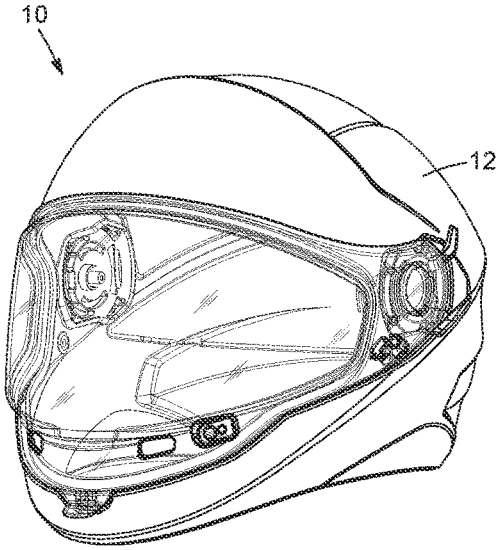
FIGS. 30 to 31B illustrate another alternate embodiment of the helmet, showing mounting bases integrally formed with the helmet shell.
Figure 31:
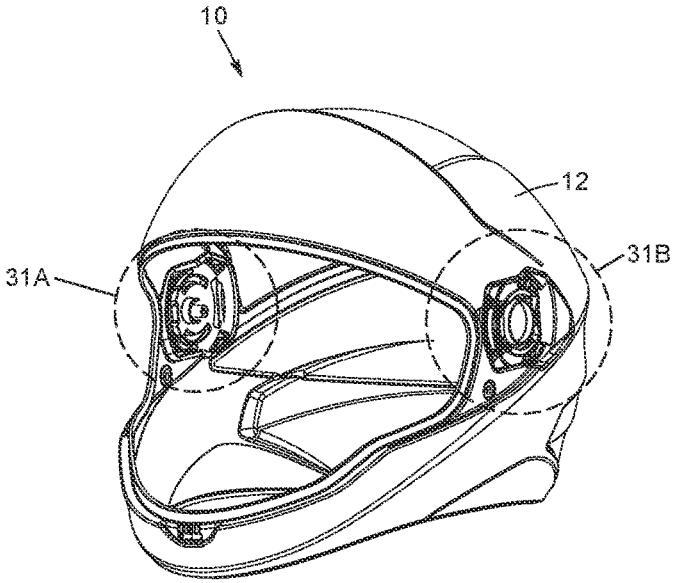
Figure 31A:
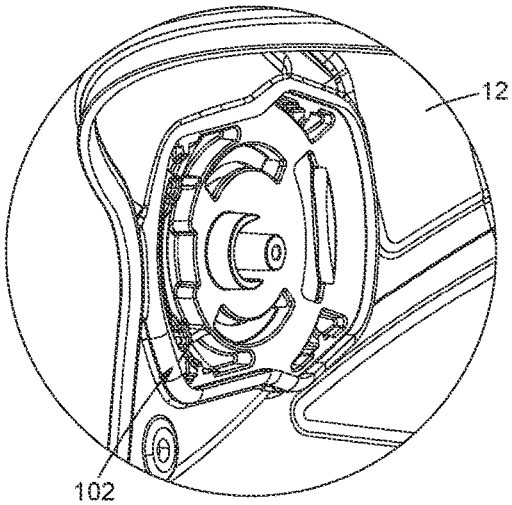
Figure 31B:
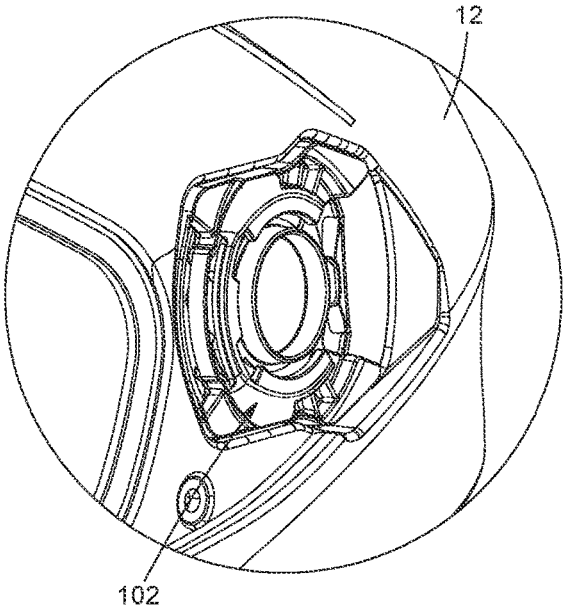
Figure 32:
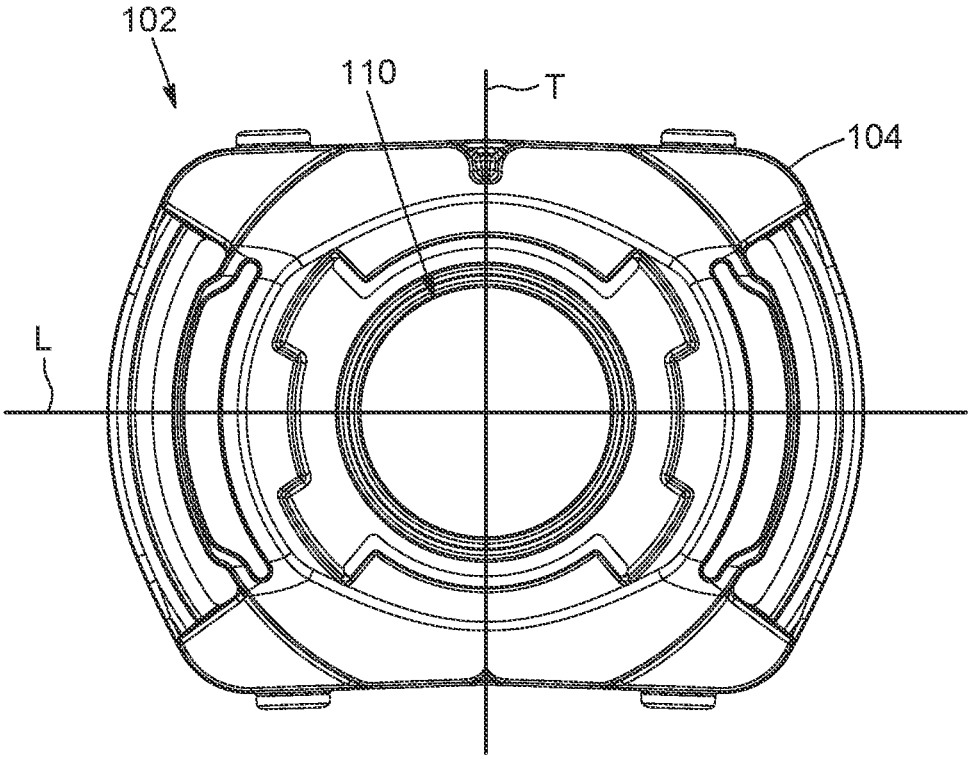
FIGS. 32 to 35 illustrate an alternate embodiment of the mounting base, showing a single pivot on a symmetrical mounting base.
Figure 33:
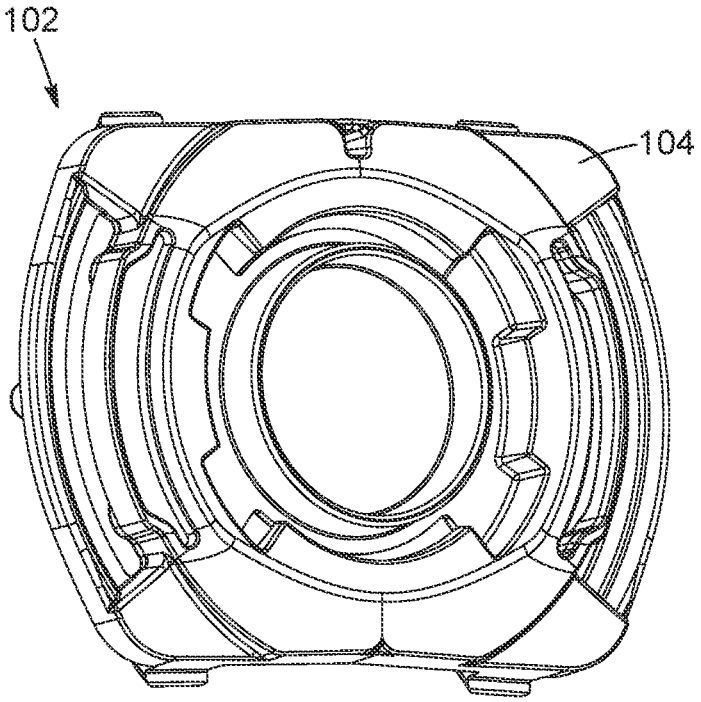
Figure 34:
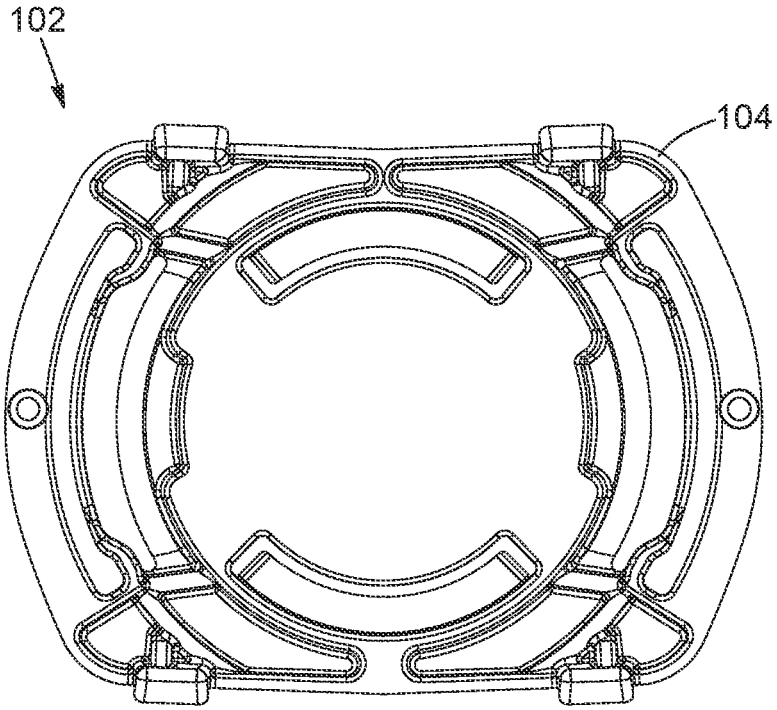
Figure 35:
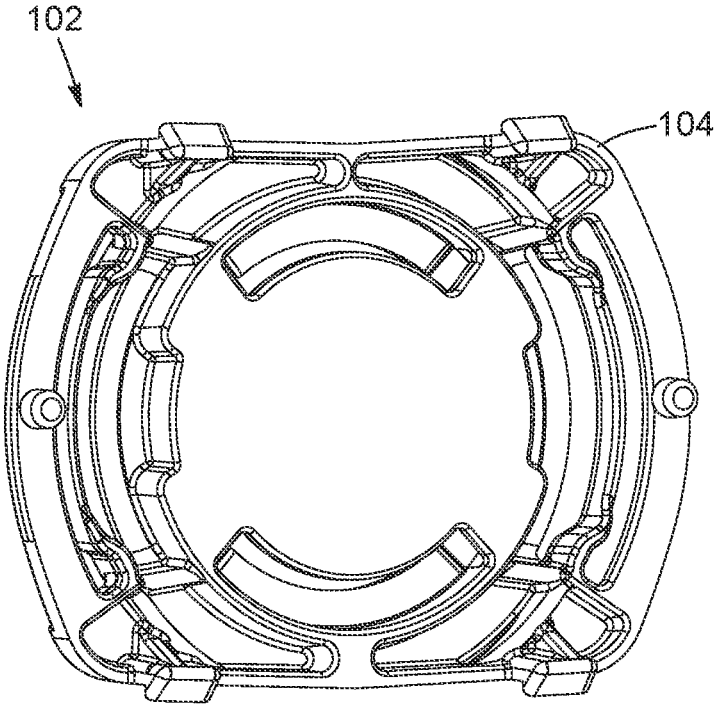

The present disclosure may be embodied in other specific forms without departing from the subject matter of the claims. The described example embodiments are to be considered in all respects as being only illustrative and not restrictive. For example, in the embodiments described herein, the mounting bases of the visor mounting system are removably connected to the helmet, enabling interchanging the mounting bases between the left and right helmet mounting sections and/or replacement of the mounting bases, for example, if one becomes damaged. In alternate embodiments, and as seen in FIGS. 30 to 31B, one or both of the mounting bases 102 can be integrally formed as part of the helmet shell 12. More particularly, the helmet shell can be made using a mold which would include the structural features and other characteristics of the mounting base(s) as described herein. In such embodiments, it is appreciated that one or both of the visors can be coupled directly to the helmet shell.

It should also be noted that, in some embodiments, the mounting bases can be adapted to be interchangeable between the left and right helmet mounting sections, but also reversible on any given helmet mounting section. In this embodiment, the inner surface can be provided with a first pair of pivots, i.e., the first pivot and the second pivot, and the outer surface can be provided with a second pair of pivots. As such, the mounting bases can be connected to either one of the helmet mounting sections, and with any one of the inner and outer surfaces facing the helmet. The mounting base can alternatively be provided with additional pivots disposed at various other locations to further permit modulation of the helmet with different visors or visor assemblies.

Another alternate embodiment is shown in FIGS. 32 to 35, where the mounting base 102 includes a unitary body 104 having only the first pivot 110 defined thereon. The unitary body is illustratively symmetrical relative to at least one of a transversal axis (T) and a longitudinal axis (L). As such, the mounting base 102 can be coupled to the helmet shell on either sides thereof, and/or in any orientation in which the mounting base can clip into the helmet mounting section. In this embodiment, it is noted that the secondary visor is either absent from the helmet, or connectable to a mounting base (or a portion thereof) which is integrated with the helmet shell, as previously described.

The present disclosure intends to cover and embrace all suitable changes in technology. The scope of the present disclosure is, therefore, described by the appended claims rather than by the foregoing description. The scope of the claims should not be limited by the embodiments set forth in the examples, but should be given the broadest interpretation consistent with the description as a whole.

As used herein, the terms "coupled", "coupling", "attached", "connected" or variants thereof as used herein can have several different meanings depending in the context in which these terms are used. For example, the terms coupled, coupling, connected or attached can have a mechanical connotation. For example, as used herein, the terms coupled, coupling or attached can indicate that two elements or devices are directly connected to one another or connected to one another through one or more intermediate elements or devices via a mechanical element depending on the particular context.

In the present disclosure, an embodiment is an example or implementation of the described features. The various appearances of "one embodiment," "an embodiment" or "some embodiments" do not necessarily all refer to the same embodiments. Although various features may be described in the context of a single embodiment, the features may also be provided separately or in any suitable combination. Conversely, although the helmet and/or the visor mounting system may be described herein in the context of separate embodiments for clarity, it may also be embodied in a single embodiment. Reference in the specification to "some embodiments", "an embodiment", "one embodiment", or "other embodiments", means that a particular feature, structure, or characteristic described in connection with the embodiments is included in at least some embodiments, but not necessarily in all embodiments.

In the above description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

In addition, although the optional configurations as illustrated in the accompanying drawings comprises various components and although the optional configurations of the helmet as shown may consist of certain geometrical configurations as explained and illustrated herein, not all of these components and geometries are essential and thus should not be taken in their restrictive sense, i.e., should not be taken as to limit the scope of the present disclosure. It is to be understood that other suitable components and cooperations thereinbetween, as well as other suitable geometrical configurations may be used for the embodiment and use of the helmet, and corresponding parts, as briefly explained and as can be easily inferred herefrom, without departing from the scope of the disclosure.

The invention claimed is:

1. A helmet comprising:

a helmet shell defining a cavity, the helmet shell comprising left and right helmet mounting sections defined on left and right sides thereof;

a visor mounting system comprising a primary visor connector made of a single piece and adapted for connection with the left and right helmet mounting sections; and a primary visor removably and pivotally connected to the primary visor connector and adapted to pivot about a primary pivot axis, wherein the left and right helmet mounting sections are asymmetric in order to enable the connection of a pair of identical primary visor connectors to respective helmet mounting sections and in respective orientations, and wherein the primary visor comprises visor mounting sections removably and pivotally connectable to the primary visor connector, and wherein the visor mounting sections are asymmetric to enable connection to the pair of identical primary visor connectors positioned in respective orientations.

2. The helmet of claim 1, wherein the visor mounting system further comprises a secondary visor connector made of a singular piece, the secondary visor connector being removably and operatively coupled to the primary visor connector, and wherein the helmet further comprises a secondary visor removably and pivotally connected to the secondary visor connector.

3. The helmet of claim 2, wherein the primary visor is configured for direct manual operation for enabling rotational movement thereof, and wherein the secondary visor is configured for manual operation via the secondary visor connector for enabling rotational movement thereof.

4. The helmet of claim 1, wherein the visor mounting system comprises a pair of primary visor connectors removably connectable with the left and right helmet mounting sections, and wherein the primary visor connectors are interchangeable between the left and right helmet mounting sections.

5. The helmet of claim 2, wherein the primary visor comprises visor mounting sections removably and pivotally connectable to one of an inner surface and an outer surface of the primary visor connector, and wherein the secondary visor comprises secondary mounting sections removably and pivotally connectable to the other one of the inner surface and the outer surface of the primary visor connector.

6. The helmet of claim 5, wherein the secondary mounting sections are removably and pivotally connectable to the inner surface of the primary visor connector, between the helmet shell and the primary visor connector.

7. The helmet of claim 5, wherein each primary visor connector comprises a first pivot provided on the outer surface and defining a first pivot axis, and further comprises a second pivot provided on the inner surface defining a second pivot axis, the primary visor being adapted to rotate about the first pivot and the secondary visor being adapted to rotate about the second pivot.

8. The helmet of claim 7, wherein the first pivot axis and the second pivot axis are spaced from each other along a length of the primary visor connector.

9. The helmet of claim 7, wherein the first pivot axis and the second pivot axis are parallel.

10. The helmet of claim 7, wherein the first pivot comprises an outer circular flange extending from the outer surface of the primary visor connector, and wherein the visor mounting sections each comprise an inner circular flange complementarily shaped relative to the outer circular flange to engage therewith.

11. The helmet of claim 7, wherein the second pivot comprises an inner protrusion extending from the inner surface of the unitary body, and wherein each secondary visor mounting section includes an opening shaped and adapted to receive the inner protrusion therein.

12. The helmet of claim 11, wherein the secondary visor connector is pivotally connectable to the inner protrusion of one of the primary visor connectors, and wherein the secondary visor mounting sections include an actuated mounting section adapted to be removably secured to the secondary visor connector and a support mounting section adapted to be pivotally connected to the inner protrusion of the other one of the primary visor connectors, the secondary visor connector being selectively pivotable to open and close the secondary visor.

13. The helmet of claim 5, wherein the primary visor connector comprises a radial aperture defined therethrough, and wherein the primary visor comprises a protrusion extending inwardly proximate one of the visor mounting sections, the protrusion being adapted to engage and travel along the radial aperture to guide a rotational movement of the primary visor between an open position and a closed position.

14. The helmet of claim 13, wherein the radial aperture comprises opposite ends respectively defining rotational stops adapted to prevent further movement of the protrusion, and wherein each rotational stop comprises a recessed portion for receiving the protrusion therein.

15. The helmet of claim 13, wherein the primary visor connector comprises a biasing element extending along at least a portion of the radial aperture, the biasing element being adapted to generate a biasing force on the protrusion within the radial aperture.

16. The helmet of claim 15, wherein the biasing element comprises a resilient runner extending along a length of the radial aperture and configured to bias the protrusion toward the recessed portion closest thereto.

17. The helmet of claim 5, further comprising an anchoring system configured to selectively retain the visor mounting sections connected to the primary visor connector, the anchoring system comprising a visor anchor defined on the visor mounting sections, and a visor anchor retaining profile defined on the primary visor connector, the visor anchor being adapted to slidably engage the visor anchor retaining profile and at least partially prevent disengagement of the visor mounting sections from the primary visor connector.

18. The helmet of claim 17, wherein the visor anchor retaining profile comprises an anchor channel defined by an overhang extending from and above the outer surface of the primary visor connector, and wherein the visor anchor is adapted to slidably engage the anchor channel beneath the overhang.

19. A helmet comprising:

a helmet shell defining a cavity, the helmet shell comprising left and right helmet mounting sections defined on left and right sides thereof;

a visor mounting system comprising a primary visor connector made of a single piece and adapted for connection with the left and right helmet mounting sections; and a primary visor removably and pivotally connected to the primary visor connector and adapted to pivot about a primary pivot axis, wherein the visor mounting system further comprises a secondary visor connector made of a singular piece, the secondary visor connector being removably and operatively coupled to the primary visor connector, and wherein the helmet further comprises a secondary visor removably and pivotally connected to the secondary visor connector, wherein the primary visor comprises visor mounting sections removably and pivotally connectable to an outer surface of the primary visor connector, and wherein the secondary visor comprises secondary mounting sections removably and pivotally connectable to an inner surface of the primary visor connector, and wherein each primary visor connector comprises a first pivot provided on the outer surface and defining a first pivot axis, and further comprises a second pivot provided on the inner surface defining a second pivot axis, the primary visor being adapted to rotate about the first pivot and the secondary visor being adapted to rotate about the second pivot.

20. A helmet comprising:

a helmet shell defining a cavity, the helmet shell comprising left and right helmet mounting sections defined on left and right sides thereof;

a visor mounting system comprising a primary visor connector made of a single piece and adapted for connection with the left and right helmet mounting sections; and a primary visor removably and pivotally connected to the primary visor connector and adapted to pivot about a primary pivot axis, wherein the visor mounting system further comprises a secondary visor connector made of a singular piece, the secondary visor connector being removably and operatively coupled to the primary visor connector, and wherein the helmet further comprises a secondary visor removably and pivotally connected to the secondary visor connector, wherein the primary visor comprises visor mounting sections removably and pivotally connectable to one of an inner surface and an outer surface of the primary visor connector, and wherein the secondary visor comprises secondary mounting sections removably and pivotally connectable to the other one of the inner surface and the outer surface of the primary visor connector, and wherein the helmet further comprises an anchoring system configured to selectively retain the visor mounting sections connected to the primary visor connector, the anchoring system comprising a visor anchor defined on the visor mounting sections, and a visor anchor retaining profile defined on the primary visor connector, the visor anchor being adapted to slidably engage the visor anchor retaining profile and at least partially prevent disengagement of the visor mounting sections from the primary visor connector.

* * * * *